US011000742B2

(12) United States Patent
Schweigert et al.

(10) Patent No.: US 11,000,742 B2
(45) **Date of Patent: *May 11, 2021**

(54) GOLF CLUB HEADS AND METHODS TO MANUFACTURE GOLF CLUB HEADS

(71) Applicant: Parsons Xtreme Golf, LLC, Scottsdale, AZ (US)

(72) Inventors: Bradley D. Schweigert, Cave Creek, AZ (US); Michael R. Nicolette, Scottsdale, AZ (US); Caleb S. Kroloff, Phoenix, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/713,942

(22) Filed: Dec. 13, 2019

(65) Prior Publication Data

US 2020/0114227 A1 Apr. 16, 2020

Related U.S. Application Data

(63) Continuation-in-part of application No. 16/372,009, filed on Apr. 1, 2019, now Pat. No. 10,821,334, which is a continuation of application No. 15/875,416, filed on Jan. 19, 2018, now Pat. No. 10,293,220, which is a continuation of application (Continued)

(51) Int. Cl.
*A63B 53/04* (2015.01)
*A63B 60/02* (2015.01)

(52) U.S. Cl.
CPC ..... *A63B 53/0466* (2013.01); *A63B 53/04* (2013.01); *A63B 60/02* (2015.10); *A63B 53/045* (2020.08); *A63B 53/0408* (2020.08); *A63B 53/0412* (2020.08); *A63B 53/0433* (2020.08); *A63B 53/0454* (2020.08); *A63B 53/0458* (2020.08); *A63B 53/0462* (2020.08); *A63B 2053/0491* (2013.01)

(58) Field of Classification Search
CPC ..... A63B 2053/0454; A63B 53/0466; A63B 2053/045; A63B 2053/0458; A63B 2053/0462; A63B 53/0454; A63B 53/045; A63B 53/0458; A63B 53/0462; A63B 53/0408
USPC ..... 473/342, 343, 345, 346, 350
See application file for complete search history.

(56) References Cited

U.S. PATENT DOCUMENTS 5,219,408 A 6/1993 Sun
5,971,868 A 10/1999 Kosmatka
(Continued)

OTHER PUBLICATIONS

International Search Report and Written Opinion Received in Connection With the Corresponding Application No. PCT/US2017/013031, dated May 26, 2017 (14 pages).

*Primary Examiner* — Benjamin Layno

(57) ABSTRACT

Embodiments of golf club heads and methods to manufacture golf club heads are generally described herein. In one example, a golf club head may include a body portion having a front portion including a face portion, a rear portion, a toe portion, a heel portion, a top portion, and a bottom portion. The face portion may have a center portion, an outer wall portion surrounding the center portion, and one or more inner wall portions connecting the center portion to the outer wall portion. Other examples and embodiments may be described and claimed.

18 Claims, 14 Drawing Sheets

Related U.S. Application Data

No. 15/446,842, filed on Mar. 1, 2017, now Pat. No. 9,895,582, which is a continuation of application No. 15/377,120, filed on Dec. 13, 2016, now Pat. No. 9,802,087, which is a continuation of application No. 14/939,849, filed on Nov. 12, 2015, now Pat. No. 9,555,295, which is a continuation of application No. 14/615,606, filed on Feb. 6, 2015, now Pat. No. 9,199,140, application No. 16/713,942, which is a continuation-in-part of application No. 16/290,610, filed on Mar. 1, 2019, now Pat. No. 10,617,918, which is a continuation of application No. 15/875,496, filed on Jan. 19, 2018, now Pat. No. 10,252,123, which is a continuation of application No. 15/457,627, filed on Mar. 13, 2017, now Pat. No. 9,895,583, which is a continuation of application No. 15/189,806, filed on Jun. 22, 2016, now Pat. No. 9,636,554, which is a continuation of application No. 14/667,546, filed on Mar. 24, 2015, now Pat. No. 9,399,158, which is a continuation-in-part of application No. 14/615,606, filed on Feb. 6, 2015, now Pat. No. 9,199,140, application No. 16/713,942, which is a continuation-in-part of application No. 16/375,553, filed on Apr. 4, 2019, now Pat. No. 10,695,623, which is a continuation of application No. 15/967,117, filed on Apr. 30, 2018, now Pat. No. 10,293,221, which is a continuation of application No. 15/457,618, filed on Mar. 13, 2017, now Pat. No. 9,987,526, which is a continuation of application No. 15/163,393, filed on May 24, 2016, now Pat. No. 9,662,547, which is a continuation of application No. 14/667,541, filed on Mar. 24, 2015, now Pat. No. 9,352,197, application No. 16/713,942, which is a continuation-in-part of application No. 16/418,691, filed on May 21, 2019, now Pat. No. 10,653,928, which is a continuation of application No. 15/803,157, filed on Nov. 3, 2017, now Pat. No. 10,335,645, which is a continuation of application No. 15/290,859, filed on Oct. 11, 2016, now Pat. No. 9,814,945, which is a continuation of application No. 15/040,892, filed on Feb. 10, 2016, now Pat. No. 9,550,096, application No. 16/713,942, which is a continuation-in-part of application No. 16/539,397, filed on Aug. 13, 2019, now Pat. No. 10,786,712, which is a continuation of application No. 16/035,268, filed on Jul. 13, 2019, now Pat. No. 10,420,990, which is a continuation of application No. 15/725,900, filed on Oct. 5, 2017, now Pat. No. 10,052,532, which is a continuation of application No. 15/445,253, filed on Feb. 28, 2017, now Pat. No. 9,795,843, which is a continuation of application No. 15/227,281, filed on Aug. 3, 2016, now Pat. No. 9,782,643, application No. 16/713,942, which is a continuation of application No. 16/198,128, filed on Nov. 21, 2018, now Pat. No. 10,532,257, which is a continuation of application No. 15/583,756, filed on May 1, 2017, now Pat. No. 10,143,899, which is a continuation of application No. 15/271,574, filed on Sep. 21, 2016, now Pat. No. 9,669,270.

(60) Provisional application No. 62/042,155, filed on Aug. 26, 2014, provisional application No. 62/048,693, filed on Sep. 10, 2014, provisional application No. 62/101,543, filed on Jan. 9, 2015, provisional application No. 62/105,123, filed on Jan. 19, 2015, provisional application No. 62/115,024, filed on Feb. 11, 2015, provisional application No. 62/120,760, filed on Feb. 25, 2015, provisional application No. 62/138,918, filed on Mar. 26, 2015, provisional application No. 62/184,757, filed on Jun. 25, 2015, provisional application No. 62/194,135, filed on Jul. 17, 2015, provisional application No. 62/195,211, filed on Jul. 21, 2015, provisional application No. 62/296,506, filed on Feb. 17, 2016, provisional application No. 62/301,756, filed on Mar. 1, 2016, provisional application No. 62/362,491, filed on Jul. 14, 2016, provisional application No. 62/291,793, filed on Feb. 5, 2016, provisional application No. 62/109,510, filed on Jan. 29, 2015, provisional application No. 62/281,639, filed on Jan. 21, 2016.

(56) References Cited

U.S. PATENT DOCUMENTS

| | | | | |
|---|---|---|---|---|
| 6,354,962 | B1 | 3/2002 | Galloway et al. | |
| 6,368,234 | B1 | 4/2002 | Galloway | |
| 6,398,666 | B1 | 6/2002 | Evans et al. | |
| 6,435,977 | B1 | 8/2002 | Helmstetter et al. | |
| 6,506,127 | B2 | 1/2003 | Helmstetter et al. | |
| 6,620,056 | B2 | 9/2003 | Galloway et al. | |
| 6,623,377 | B2 | 9/2003 | Evans et al. | |
| 6,800,040 | B2 | 10/2004 | Galloway et al. | |
| 6,863,626 | B2 | 3/2005 | Evans et al. | |
| 6,997,821 | B2 | 2/2006 | Galloway et al. | |
| 7,014,570 | B2 | 3/2006 | Evans et al. | |
| 7,101,289 | B2 | 9/2006 | Gibbs et al. | |
| 7,125,344 | B2 | 10/2006 | Hocknell et al. | |
| 7,137,907 | B2 | 11/2006 | Gibbs et al. | |
| 7,147,757 | B2 | 12/2006 | Luyken et al. | |
| 7,258,626 | B2 | 8/2007 | Gibbs et al. | |
| 7,261,646 | B2 | 8/2007 | De Shiell et al. | |
| 7,422,528 | B2 | 9/2008 | Gibbs et al. | |
| 7,448,960 | B2 | 11/2008 | Gibbs et al. | |
| 7,494,425 | B2 | 2/2009 | De Shiell et al. | |
| 7,575,524 | B2 | 8/2009 | Willett et al. | |
| 7,713,140 | B2 | 5/2010 | Gibbs et al. | |
| 7,967,700 | B2 | 6/2011 | Stites | |
| 8,012,041 | B2 | 9/2011 | Gibbs et al. | |
| 8,016,691 | B2 | 9/2011 | Stites | |
| 8,070,623 | B2 | 12/2011 | Stites et al. | |
| 8,096,896 | B2 | 1/2012 | De Schiell et al. | |
| 8,226,498 | B2 | 7/2012 | Stites et al. | |
| 8,287,402 | B2 | 10/2012 | De Shiell et al. | |
| 8,376,876 | B2 | 2/2013 | Gibbs et al. | |
| 8,403,769 | B2 | 3/2013 | Stites | |
| 8,602,912 | B2 | 12/2013 | Stites | |
| 8,657,701 | B2 | 2/2014 | Boyd et al. | |
| 8,696,489 | B2 | 4/2014 | Gibbs et al. | |
| 8,814,724 | B2 | 8/2014 | Kato | |
| 8,845,454 | B2 | 9/2014 | Boyd et al. | |
| 9,101,809 | B2 | 8/2015 | Gibbs et al. | |
| 9,168,436 | B2 | 10/2015 | Slaughter et al. | |
| 9,452,325 | B2 | 9/2016 | DeShiell et al. | |
| 9,669,270 | B2 | 6/2017 | Schweigert et al. | |
| 9,839,821 | B2 | 12/2017 | Deshiell et al. | |
| 10,143,899 | B2 | 12/2018 | Schweigert et al. | |
| 10,532,257 | B2 * | 1/2020 | Schweigert | A63B 60/00 |
| 2002/0028714 | A1 | 3/2002 | Kosmatka | |
| 2003/0199335 | A1 * | 10/2003 | Bissonnette | A63B 60/00 473/342 |
| 2005/0209021 | A1 | 9/2005 | Hoffman et al. | |
| 2006/0194644 | A1 | 8/2006 | Nishio | |
| 2008/0004129 | A1 | 1/2008 | Lin et al. | |
| 2008/0248896 | A1 | 10/2008 | Hirano | |
| 2009/0264218 | A1 | 10/2009 | Willett et al. | |
| 2012/0021849 | A1 * | 1/2012 | Gibbs | A63B 53/0466 473/342 |

(56) References Cited

U.S. PATENT DOCUMENTS

| | | | | |
|---|---|---|---|---|
| 2012/0064994 | A1* | 3/2012 | Wada | A63B 60/00 473/346 |
| 2017/0007892 | A1 | 1/2017 | Schweigert et al. | |

* cited by examiner

GOLF CLUB HEADS AND METHODS TO MANUFACTURE GOLF CLUB HEADS

CROSS REFERENCE

This application is a continuation-in-part of application Ser. No. 16/372,009, filed Apr. 1, 2019, now U.S. Pat No. 10,821,334, which is a continuation of application Ser. No. 15/875,416, filed Jan. 19, 2018, now U.S. Pat. No. 10,293,220, which is a continuation of application Ser. No. 15/446,842, filed Mar. 1, 2017, now U.S. Pat. No. 9,895,582, which is a continuation of application Ser. No. 15/377,120, filed Dec. 13, 2016, now U.S. Pat. No. 9,802,087, which is a continuation of application Ser. No. 14/939,849, filed Nov. 12, 2015, now U.S. Pat. No. 9,555,295, which is a continuation of application Ser. No. 14/615,606, filed Feb. 6, 2015, now U.S. Pat. No. 9,199,140.

This application is a continuation-in-part of application Ser. No. 16/290,610, filed Mar. 1, 2019, now U.S. Pat No. 10,617,918, which is a continuation of application Ser. No. 15/875,496, filed Jan. 19, 2018, now U.S. Pat. No. 10,252,123, which is a continuation of application Ser. No. 15/457,627, filed Mar. 13, 2017, now U.S. Pat. No. 9,895,583, which is a continuation of application Ser. No. 15/189,806, filed Jun. 22, 2016, now U.S. Pat. No. 9,636,554, which is a continuation of application Ser. No. 14/667,546, filed Mar. 24, 2015, now U.S. Pat. No. 9,399,158, which is a continuation-in-part of application Ser. No. 14/615,606, filed Feb. 6, 2015, now U.S. Pat. No. 9,199,140, which claims the benefit of U.S. Provisional Application No. 62/042,155, filed Aug. 26, 2014, U.S. Provisional Application No. 62/048,693, filed Sep. 10, 2014, U.S. Provisional Application No. 62/101,543, filed Jan. 9, 2015, U.S. Provisional Application No. 62/105,123, filed Jan. 19, 2015, and U.S. Provisional Application No. 62/109,510, filed Jan. 29, 2015.

This application is a continuation-in-part of application Ser. No. 16/375,553, filed Apr. 4, 2019, now U.S. Pat. No. 10,695,623, which is a continuation of application Ser. No. 15/967,117, filed Apr. 30, 2018, now U.S. Pat. No. 10,293,221, which is a continuation application Ser. No. 15/457,618, filed Mar. 13, 2017, now U.S. Pat. No. 9,987,526, which is a continuation of application Ser. No. 15/163,393, filed May 24, 2016, now U.S. Pat. No. 9,662,547, which is a continuation of application Ser. No. 14/667,541, filed Mar. 24, 2015, now U.S. Pat. No. 9,352,197.

This application is a continuation-in-part of application Ser. No. 16/418,691, filed May 21, 2019, now U.S. Pat. No. 10,653,928, which is a continuation of application Ser. No. 15/803,157, filed Nov. 3, 2017, now U.S. Pat. No. 10,335,645, which is a continuation of application Ser. No. 15/290,859, filed Oct. 11, 2016, now U.S. Pat. No. 9,814,945, which is a continuation of application Ser. No. 15/040,892, filed Feb. 10, 2016, now U.S. Pat. No. 9,550,096, which claims the benefit of U.S. Provisional Application No. 62/115,024, filed Feb. 11, 2015, U.S. Provisional Application No. 62/120,760, filed Feb. 25, 2015, U.S. Provisional Application No. 62/138,918, filed Mar. 26, 2015, U.S. Provisional Application No. 62/184,757, filed Jun. 25, 2015, U.S. Provisional No. 62/194,135, filed Jul. 17, 2015, and U.S. Provisional Application No. 62/195,211, filed Jul. 21, 2015.

This application is a continuation-in-part of application Ser. No. 16/539,397, filed Aug. 13, 2019, now U.S. Pat. No. 10,768,712, which is a continuation of application Ser. No. 16/035,268, filed Jul. 13, 2018, now U.S. Pat. No. 10,420,990, which is a continuation of application Ser. No. 15/725,900, filed Oct. 5, 2017, now U.S. Pat. No. 10,052,532, which is a continuation of application Ser. No. 15/445,253, filed Feb. 28, 2017, now U.S. Pat. No. 9,795,843, which is a continuation of application Ser. No. 15/227,281, filed Aug. 3, 2016, now U.S. Pat. No. 9,782,643, which claims the benefit of U.S. Provisional Application No. 62/281,639, filed Jan. 21, 2016, U.S. Provisional Application No. 62/296,506, filed Feb. 17, 2016, U.S. Provisional Application No. 62/301,756, filed Mar. 1, 2016, and U.S. Provisional Application No. 62/362,491, filed Jul. 14, 2016.

This application is a continuation of application Ser. No. 16/198,128, filed Nov. 21, 2018, now U.S. Pat. No. 10,532,257, which is a continuation of application Ser. No. 15/583,756, filed May 1, 2017, now U.S. Pat. No. 10,143,899, which is a continuation of application Ser. No. 15/271,574, filed Sep. 21, 2016, now U.S. Pat. No. 9,669,270, which claims the benefit of U.S. Provisional Application No. 62/291,793, filed Feb. 5, 2016.

The disclosures of the referenced applications are incorporated herein by reference.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to sports equipment, and more particularly, to golf club heads and methods to manufacture golf club heads.

BACKGROUND

In golf, various factors may affect the distance and direction that a golf ball may travel. In particular, the center of gravity (CG) and/or the moment of inertia (MOI) of a golf club head may affect the launch angle, the spin rate, and the direction of the golf ball at impact. Such factors may vary significantly based the type of golf swing.

Figure 1:
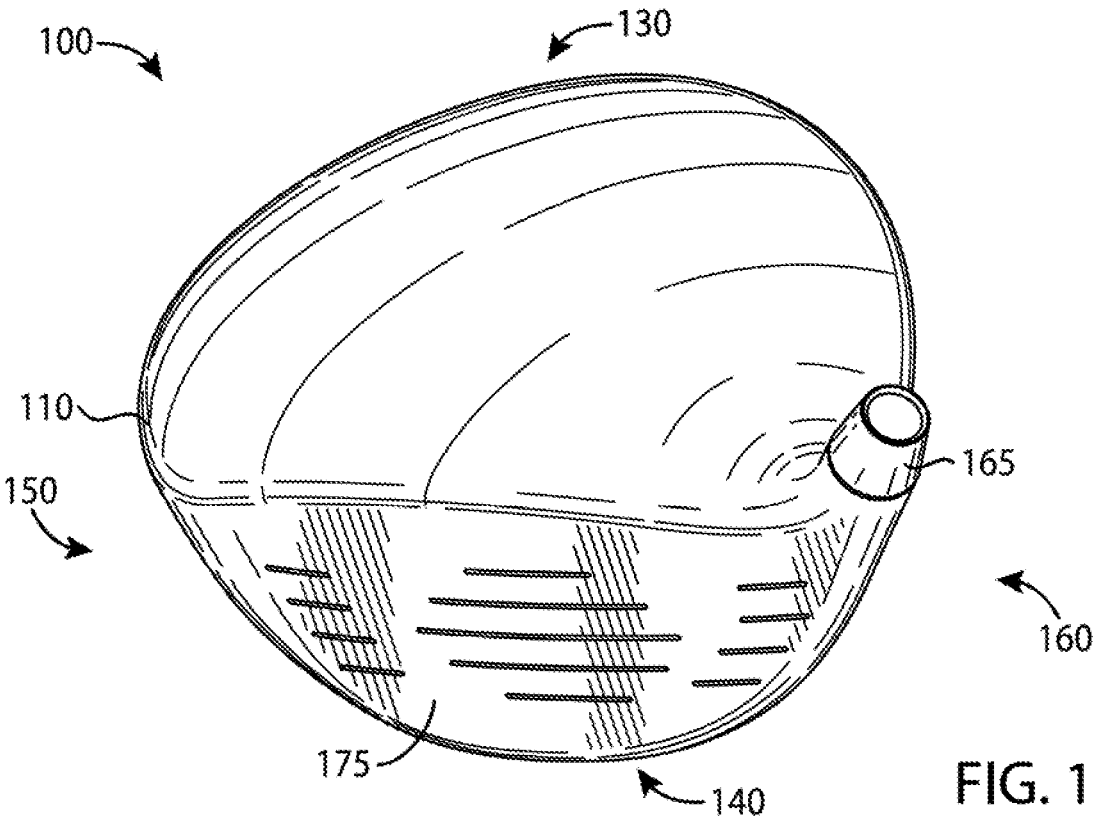
FIG. 1 is top perspective view of an example golf club head according to an embodiment of the apparatus, methods, and articles of manufacture described herein.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure.

DESCRIPTION

In general, golf club heads and methods to manufacture golf club heads are described herein. The apparatus, methods, and articles of manufacture described herein are not limited in this regard.

Figure 2:
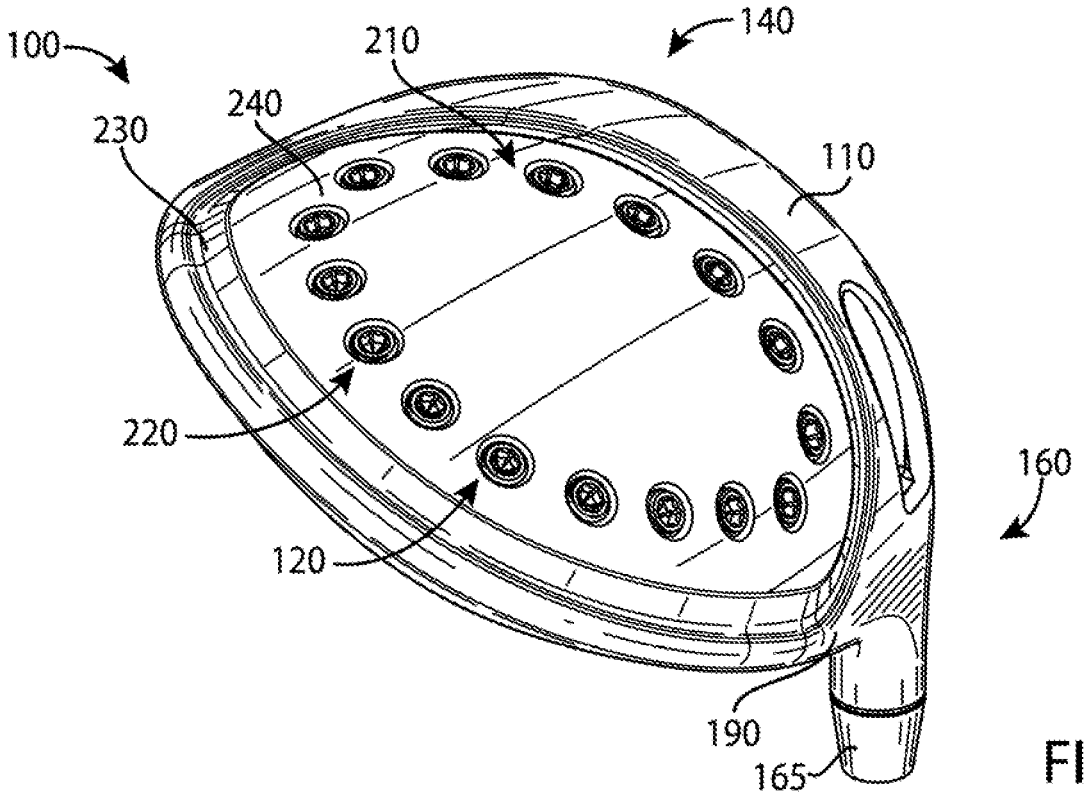
FIG. 2 depicts a bottom perspective view of the example golf club head of FIG. 1.
Figure 3:
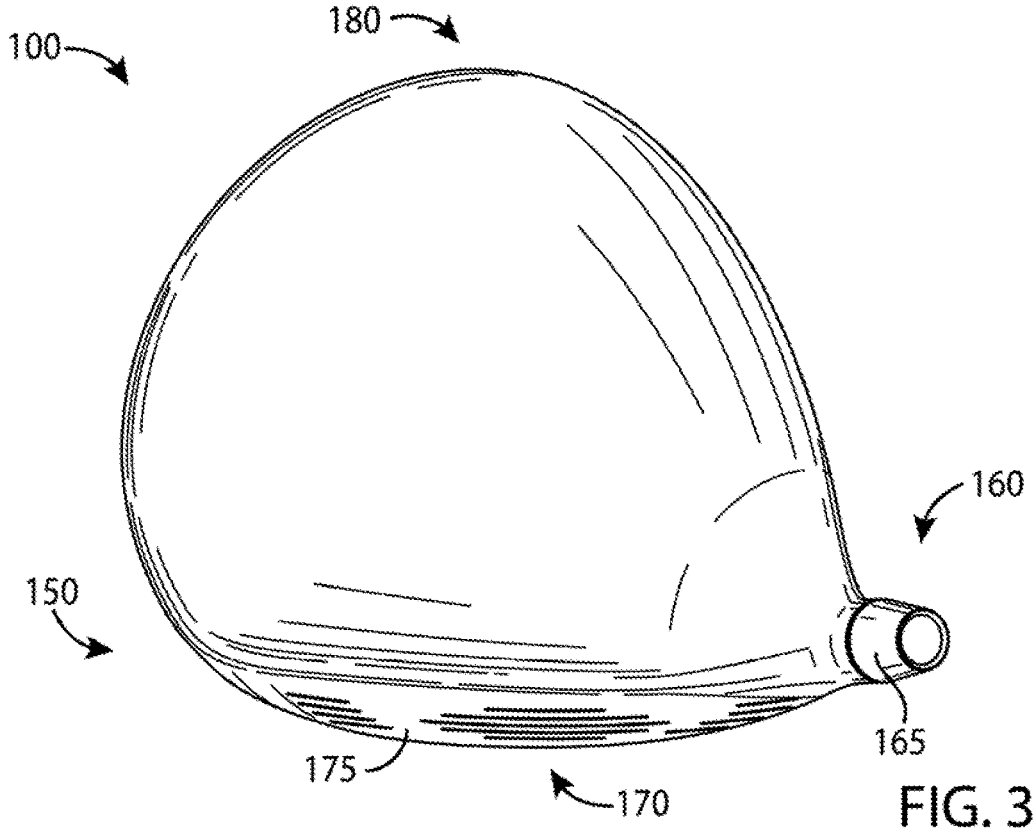
FIG. 3 depicts a top view of the example golf club head of FIG. 1.

In the example of FIGS. 1-13, a golf club head 100 may include a body portion 110, and a plurality of weight portions 120, generally, shown as a first set of weight portions 210 (FIG. 2) and a second set of weight portions 220 (FIG. 2). The body portion 110 may include a top portion 130, a bottom portion 140, a toe portion 150, a heel portion 160, a front portion 170, and a rear portion 180. The bottom portion 140 may include a skirt portion 190 defined as a side portion of the golf club head 100 between the top portion 130 and the bottom portion 140 excluding the front portion 170 and extending across a periphery of the golf club head 100 from the toe portion 150, around the rear portion 180, and to the heel portion 160. The bottom portion 140 may include a transition region 230 and a weight port region 240. For example, the weight port region 240 may be a D-shape region. The weight port region 240 may include a plurality of weight ports 900 (FIG. 9) to receive the plurality of weight portions 120. The front portion 170 may include a face portion 175 to engage a golf ball (not shown). The body portion 110 may also include a hosel portion 165 to receive a shaft (not shown). Alternatively, the body portion 110 may include a bore instead of the hosel portion 165. For example, the body portion 110 may be made partially or entirely of an aluminum-based material, a magnesium-type material, a steel-based material, a titanium-based material, any combination thereof, or any other suitable material. In another example the body portion 110 may be made partially or entirely of a non-metal material such as a ceramic material, a composite material, any combination thereof, or any other suitable material.

The golf club head 100 may have a club head volume greater than or equal to 300 cubic centimeters ($cm^3$ or cc). In one example, the golf club head 100 may be about 460 cc. Alternatively, the golf club head 100 may have a club head volume less than or equal to 300 cc. In particular, the golf club head 100 may have a club head volume between 100 cc and 200 cc. The club head volume of the golf club head 100 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 100. Although FIG. 1 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). The apparatus, methods, and articles of manufacture described herein are not limited in this regard.

Each of the first set of weight portions 210, generally shown as 405, 410, 415, 420, 425, 430, and 435 (FIG. 4), may be associated with a first mass. Each of the second set of weight portions 220, generally shown as 440, 445, 450, 455, 460, 465, 470, 475, and 480 (FIG. 4), may be associated with a second mass. The first mass may be greater than the second mass or vice versa. In one example, the first set of weight portions 210 may be made of a tungsten-based material whereas the second set of weight portions 220 may be made of an aluminum-based material. As described in detail below, the first and second set of weight portions 210 and 220, respectively, may provide various weight configurations (e.g., FIGS. 15-18).

Figure 9:
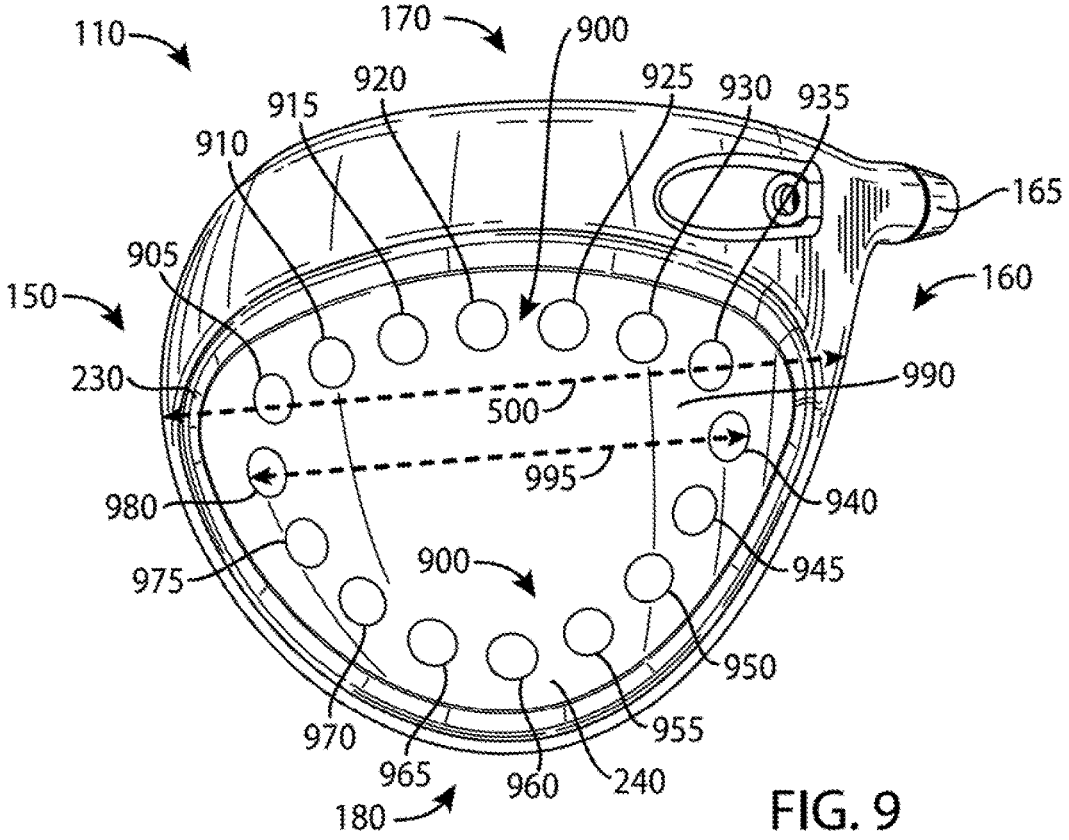
FIG. 9 depicts a bottom view of an example body portion of the example golf club head of FIG. 1.
Figure 10:
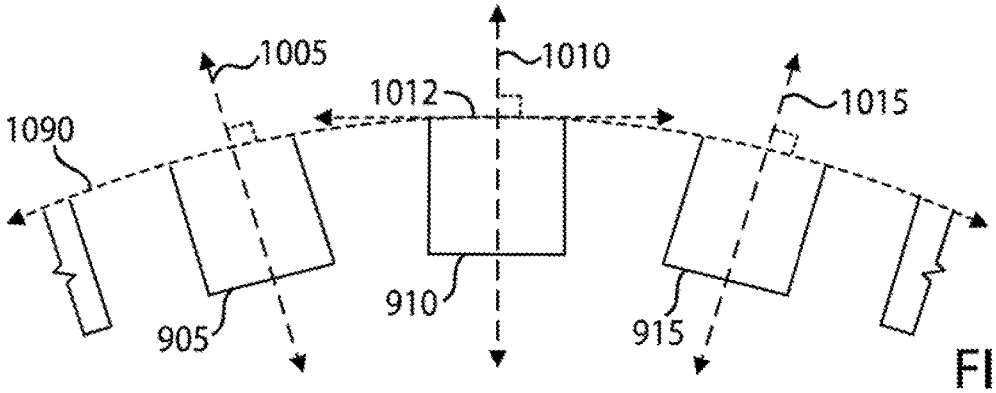
FIG. 10 depicts a cross-sectional view of the example body portion of the example golf club head of FIG. 1.
Figure 11:
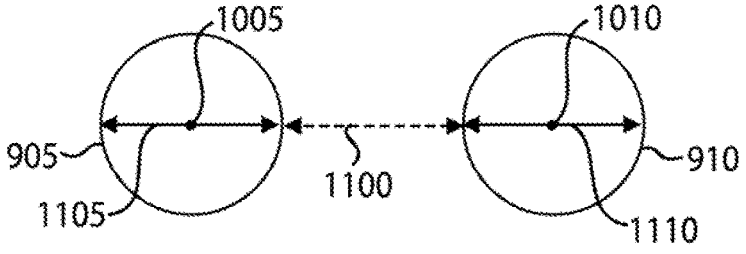
FIG. 11 depicts two weight ports of the example golf club head of FIG. 1.

Referring to FIGS. 9-11, for example, the bottom portion 140 of the body portion 110 may include a plurality of weight ports 900. The plurality of weight ports 900, generally shown as 905, 910, 915, 920, 925, 930, 935, 940, 945, 950, 955, 960, 965, 970, 975, and 980, may be located along a periphery of the weight port region 240 of the bottom portion 140. The plurality of weight ports 900 may extend across the bottom portion 140. In particular, the plurality of weight ports 900 may extend between the toe and heel portions 150 and 160, respectively, across the bottom portion 140. The plurality of weight ports 900 may also extend between the front and rear portions 170 and 180, respectively, across the bottom portion 140. The plurality of weight ports 900 may be arranged across the bottom portion 140 along a path that defines a generally D-shaped loop. In one example, the plurality of weight ports 900 may extend more than 50% of a maximum toe-to-heel distance 500 between of the toe and heel portions 150 and 160, respectively, across the bottom portion 140. The maximum toe-to-heel distance 500 of the golf club head 100 may be measured from transition regions between the top and bottom portions 130 and 140, respectively, at the toe and heel portions 150 and 160, respectively. Alternatively, the maximum toe-to-heel distance 500 may be a horizontal distance between vertical projections of the outermost points of the toe and heel portions 150 and 160, respectively. For example, the maximum toe-to-heel distance 500 may be measured when the golf club head 100 is at a lie angle 510 of about 60 degrees. If the outermost point of the heel portion 160 is not readily defined, the outermost point of the heel portion 160 may be located at a height 520 of about 0.875 inches (22.23 millimeters) above a ground plane 530 (i.e., a horizontal plane on which the golf club head 100 is lying on). In one example, the maximum toe-to-heel distance 500 may be no more than 5 inches (127 millimeters). Accordingly, the plurality of weight ports 900 may extend at least 2.5 inches between the toe and heel portions 150 and 160, respectively. A maximum toe-to-heel distance 995 of the plurality of weight ports 900 may extend between the weight ports 940 and 980. For example, the maximum toe-to-heel distance 995 of the plurality of weight ports 900 may be about 3.7 inches. As the rules of golf may change from time to time (e.g., new regulations may be adopted or old rules may be eliminated or modified by golf standard organizations and/or governing bodies), the lie angle 510 and/or the height 520 for measuring the maximum toe-to-heel distance 500 may also change. The apparatus, methods, and articles of manufacture described herein are not limited in this regard.

Each of the plurality of weight ports 900 may be associated with a port diameter ($D_{port}$) (e.g., two shown as 1105 and 1110 in FIG. 11). For example, the port diameter of each weight port of the plurality of weight ports 900 may be about 0.3 inch (7.65 millimeters). Alternatively, the port diameters of adjacent weight ports may be different. In one example, the weight port 905 may be associated with a port diameter 1105, and the weight port 910 may be associated with a port diameter 1110. In particular, the port diameter 1105 of the weight port 905 may be larger than the port diameter 1110 of the weight port 910 or vice versa. The apparatus, methods, and articles of manufacture described herein are not limited in this regard.

The bottom portion 140 may also include an outer surface 990. As illustrated in FIG. 10, for example, the plurality of weight ports 900 may be formed on the bottom portion 140 relative to an outer surface curve 1090 formed by the outer surface 990. In particular, each of the plurality of weight ports 900 may be associated with a port axis generally shown as 1005, 1010, and 1015. A center of a weight port may define the port axis of the weight port. Each port axis may be perpendicular or substantially perpendicular to a plane that is tangent to the outer surface curve 1090 at the point of intersection of the port axis and the outer surface curve 1090. In one example, substantially perpendicular may refer to a deviation of ±5° from perpendicular. In another example, substantially perpendicular may refer to a deviation of ±3° from perpendicular. The deviation from perpendicular may depend on manufacturing tolerances.

In one example, the port axis 1010 may be perpendicular or substantially perpendicular (i.e., normal) to a tangent plane 1012 of the outer surface curve 1090. Multiple fixtures may be used to manufacture the plurality of weight ports 900 by positioning the golf club head 100 in various positions. Alternatively, the weight ports may be manufactured by multiple-axis machining processes, which may be able to rotate the golf club head around multiple axes to mill away excess material (e.g., by water jet cutting and/or laser cutting) to form the plurality of weight ports 900. Further, multiple-axis machining processes may provide a suitable surface finish because the milling tool may be moved tangentially about a surface. Accordingly, the apparatus, methods, and articles of manufacture described herein may use a multiple-axis machining process to form each of the plurality of weight ports 900 on the bottom portion 140. For example, a five-axis milling machine may form the plurality of weight ports 900 so that the port axis 1000 of each of the plurality weight ports 900 may be perpendicular or substantially perpendicular to the outer surface curve 1090. The tool of the five-axis milling machine may be moved tangentially about the outer surface curve 1090 of the outer surface 990.

Turning to FIG. 11, for example, two adjacent weight ports may be separated by a port distance 1100, which may be the shortest distance between two adjacent weight ports on the outer surface 990. In particular, the port distance 1100 may be less than or equal to the port diameter of any of the two adjacent weight ports. In one example, the port distance 1100 between the weight ports 905 and 910 may be less than or equal to either the port diameter 1105 or the port diameter 1110. The apparatus, methods, and articles of manufacture described herein are not limited in this regard.

The plurality of weight portions 120 may have similar or different physical properties (e.g., density, shape, mass, volume, size, color, etc.). In one example, the first set of weight portions 210 may be a black color whereas the second set of weight portions 220 may be a gray color or a steel color. Some or all of the plurality of weight portions 120 may be partially or entirely made of a metal material such as a steel-based material, a tungsten-based material, an aluminum-based material, any combination thereof or suitable types of materials. Alternatively, some or all of the plurality of weight portions 120 may be partially or entirely made of a non-metal material (e.g., composite, plastic, etc.).

Figure 12:
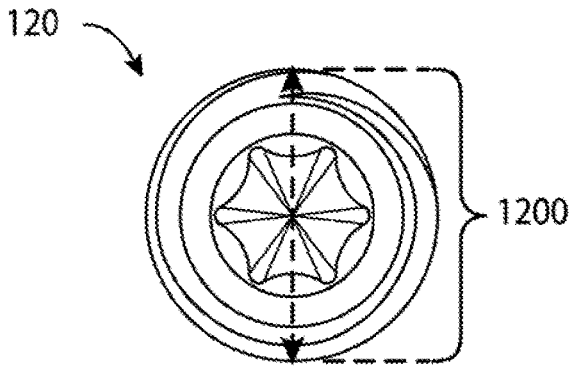
FIG. 12 depicts a top view of an example weight portion of the example golf club head of FIG. 1.
Figure 13:
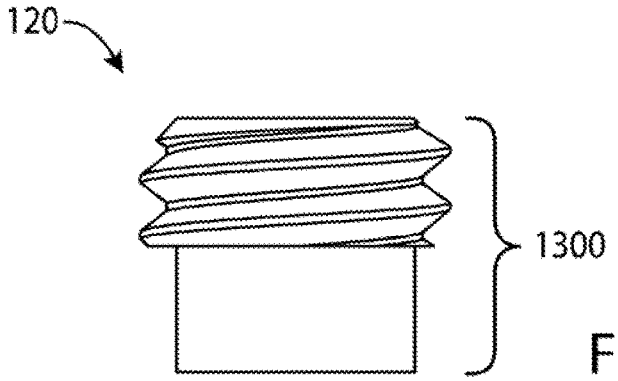
FIG. 13 depicts a side view of the example weight portion of FIG. 10.

In the illustrated example as shown in FIGS. 12 and 13, each weight portion of the plurality of weight portions 120 may have a cylindrical shape (e.g., a circular cross section). Although the above examples may describe weight portions having a particular shape, the apparatus, methods, and articles of manufacture described herein may include weight portions of other suitable shapes (e.g., a portion of or a whole sphere, cube, cone, cylinder, pyramid, cuboidal, prism, frustum, or other suitable geometric shape). Each weight portion of the plurality of weight portions 120 may be associated with a diameter 1200 and a height 1300. In one example, each weight portion of the plurality of weight portions 120 may have a diameter of about 0.3 inch (7.62 millimeters) and a height of about 0.2 inch (5.08 millimeters). Alternatively, the first and second sets of weight portions 210 and 220, respectively, may be different in width and/or height.

Instead of a rear-to-front direction as in other golf club heads, each weight portion of the plurality of weight portions 120 may engage one of the plurality of weight ports 400 in a bottom-to-top direction. The plurality of weight portions 120 may include threads to secure in the weight ports. For example, each weight portion of the plurality of weight portions 120 may be a screw. The plurality of weight portions 120 may not be readily removable from the body portion 110 with or without a tool. Alternatively, the plurality of weight portions 120 may be readily removable (e.g., with a tool) so that a relatively heavier or lighter weight portion may replace one or more of the plurality of weight portions 120. In another example, the plurality of weight portions 120 may be secured in the weight ports of the body portion 110 with epoxy or adhesive so that the plurality of weight portions 120 may not be readily removable. In yet another example, the plurality of weight portions 120 may be secured in the weight ports of the body portion 110 with both epoxy and threads so that the plurality of weight portions 120 may not be readily removable. The apparatus, methods, and articles of manufacture described herein are not limited in this regard.

Figure 14:
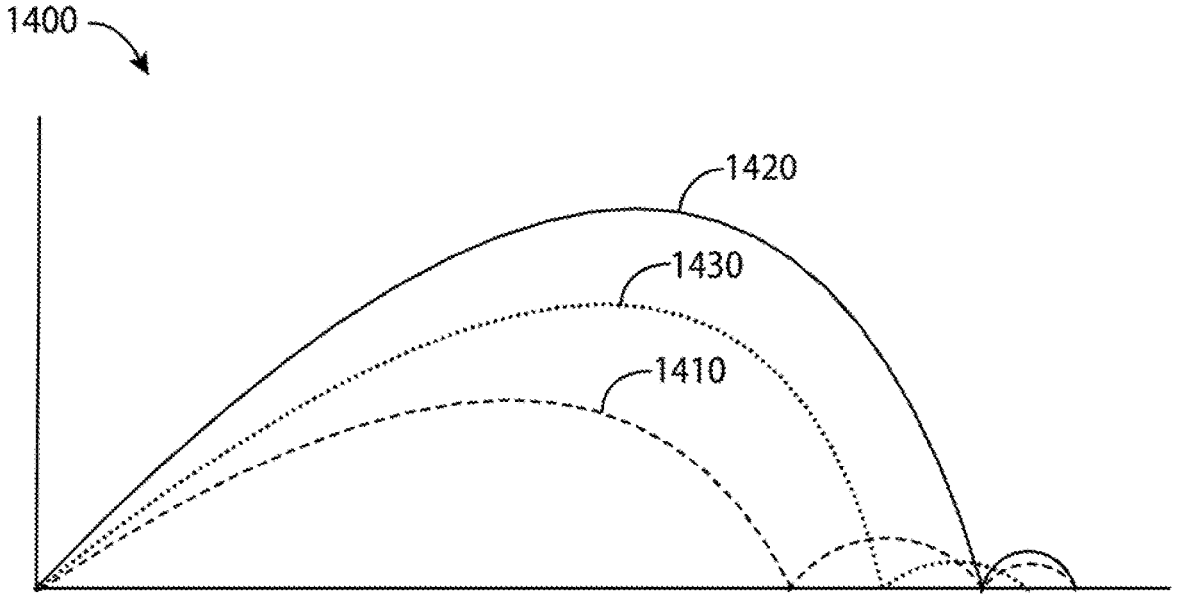
FIG. 14 depicts example launch trajectory profiles of the example golf club head of FIG. 1.
Figure 15:
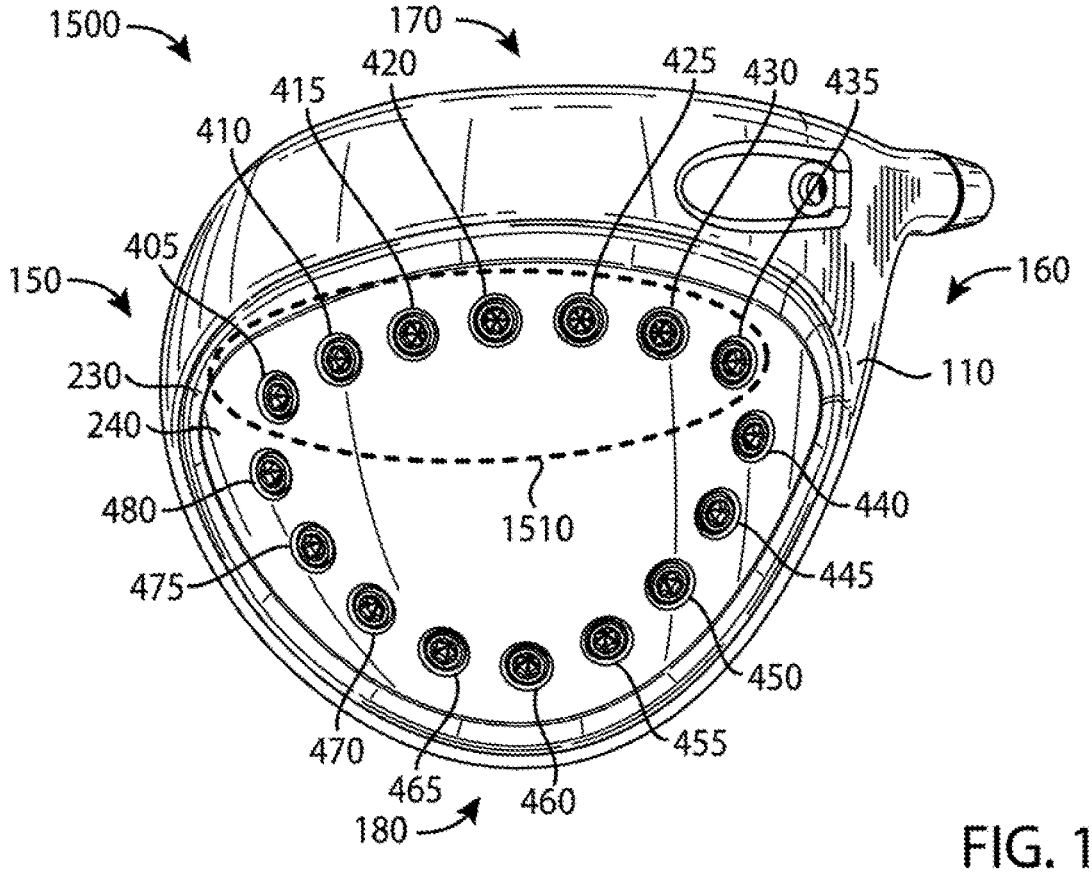
FIG. 15 depicts a first weight configuration of the example weight portions.

In contrast to other golf club heads, the golf club head 100 may accommodate at least four different types of golf swings. As illustrated in FIG. 14, for example, each weight configuration may be associated with one of the plurality of launch trajectory profiles 1400, generally shown as 1410, 1420, and 1430. Referring to FIG. 15, for example, a first weight configuration 1500 may be associated with a configuration of a first set of weight ports 1510. The first set of weight ports 1510 may be located at or proximate to the front portion 170 (e.g., weight ports 905, 910, 915, 920, 925, 930, and 935 shown in FIG. 9). In the first weight configuration 1500, a first set of weight portions may be disposed toward the front portion 170 according to the configuration of the first set of weight ports 1510, whereas a second set of weight portions may be disposed toward the rear portion 180. In particular, the first set of weight portions may form a cluster according to the configuration of the first set of weight ports 1510 at or proximate to the front portion 170. The weight portions 405, 410, 415, 420, 425, 430, and 435 may define the first set of weight portions and may be disposed in weight ports 905, 910, 915, 920, 925, 930, and 935, respectively. The weight portions 440, 445, 450, 455, 460, 465, 470, 475, and 480 may define the second set of weight portions and may be disposed in weight ports 940, 945, 950, 955, 960, 965, 970, 975, and 980, respectively. The first weight configuration 1500 may be associated with the first launch trajectory profile 1410 (FIG. 14). In particular, the first weight configuration 1500 may decrease spin rate of a golf ball. By placing relatively heavier weight portions (i.e., the first set of weight portions) towards the front portion 170 of the golf club head 100 according to the configuration of the first set of weight ports 1510, the center of gravity (GC) of the golf club head 100 may move relatively forward and lower to produce a relatively lower launch and spin trajectory. As a result, the first launch trajectory profile 1410 may be associated with a relatively greater roll distance (i.e., distance after impact with the ground). While the above example may describe the weight portions being disposed in certain weight ports, any weight portion of the first set of weight portions 210 may be disposed in any weight port of the first set of weight ports 1510.

Figure 16:
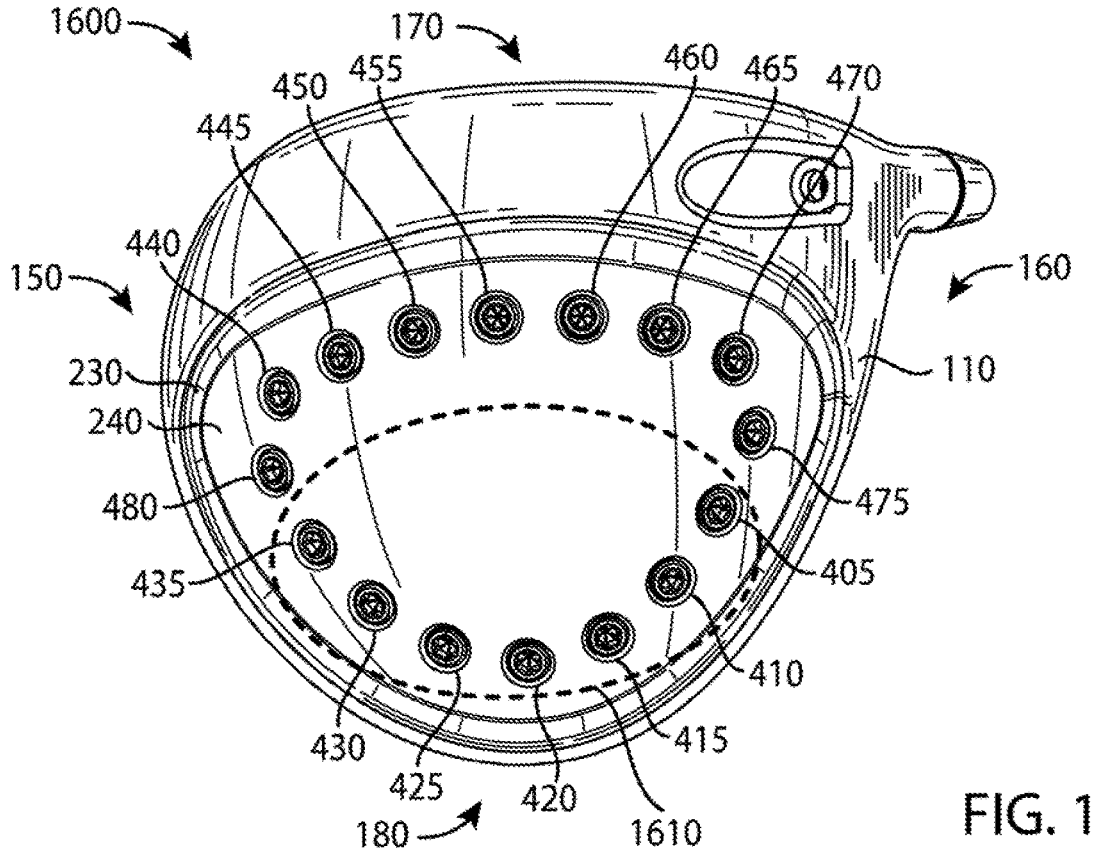
FIG. 16 depicts a second weight configuration of the example weight portions.

Turning to FIG. 16, for example, a second weight configuration 1600 may be associated with a configuration of a second set of weight ports 1610. The second set of weight ports 1610 may be located at or proximate to the rear portion 180 (e.g., weight ports, 945, 950, 955, 960, 965, 970, and 975 shown in FIG. 9). In a second weight configuration 1600 as illustrated in FIG. 16, for example, a first set of weight portions may be disposed toward the rear portion 180 whereas a second set of weight portions may be disposed toward the front portion 170. In particular, the first set of weight portions may form a cluster 1610 at or proximate to the rear portion 180 according to the configuration of the second set of weight ports 1610. The weight portions 405, 410, 415, 420, 425, 430, and 435 may define the first set of weight portions and may be disposed in weight ports 945, 950, 955, 960, 965, 970, and 975, respectively. The weight portions 440, 445, 450, 455, 460, 465, 470, 475, and 480 may define the second set of weight portions and may be disposed in weight ports 905, 910, 915, 920, 925, 930, 935, 940, and 980, respectively. The second weight configuration 1600 may be associated with the second launch trajectory profile 1420 (FIG. 14). In particular, the second weight configuration 1600 may increase launch angle of a golf ball and maximize forgiveness. By placing the relatively heavier weight portion (i.e., the first set of weight portions) towards the rear portion 180 of the golf club head 100 according to the configuration of the second set of weight ports 1610, the center of gravity (GC) of the golf club head 100 may move relatively back and up to produce a relatively higher launch and spin trajectory. Further, the moment of inertia (MOI) of the golf club head 100 may increase in both the horizontal (front-to-back axis) and vertical axes (top-to-bottom axis), which in turn, provides relatively more forgiveness on off-center hits. As a result, the second launch trajectory profile 1420 may be associated with a relatively greater carry distance (i.e., in-the-air distance).

Figure 17:
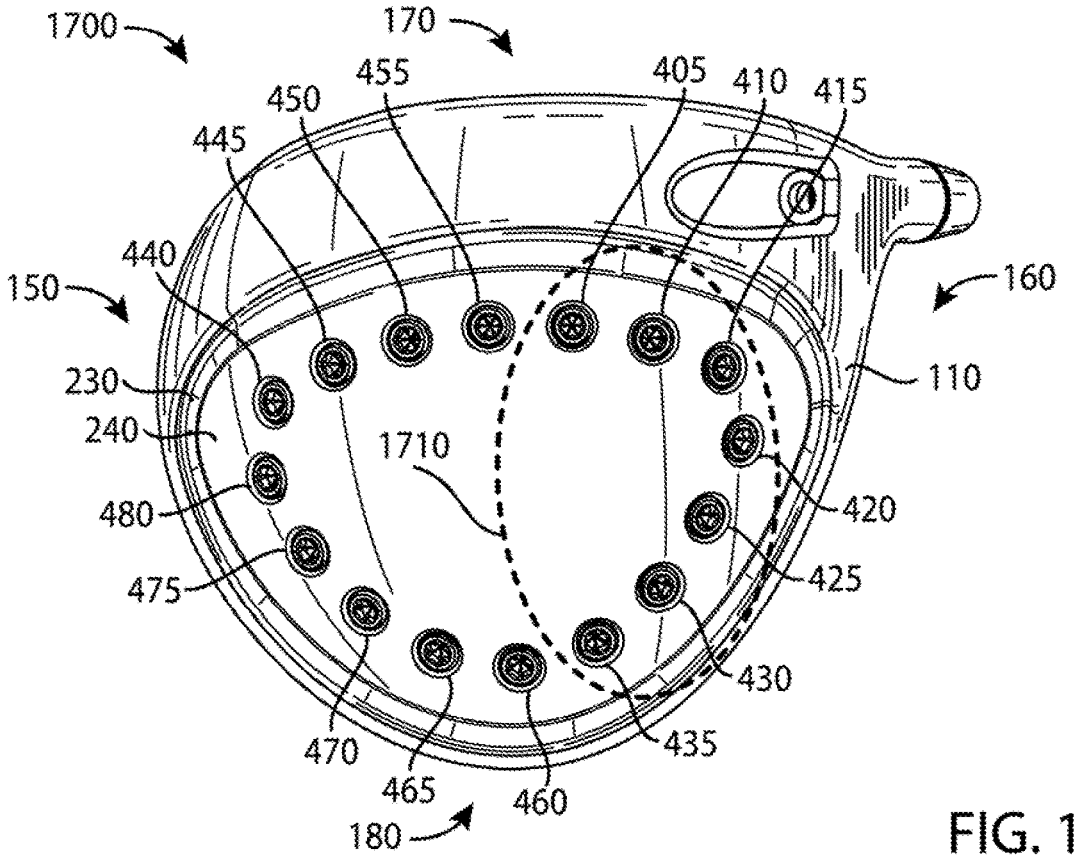
FIG. 17 depicts a third weight configuration of the example weight portions.

Turning to FIG. 17, for example, a third weight configuration 1700 may be associated with a configuration of a third set of weight ports 1710. In the third weight configuration 1700, for example, a first set of weight portions may be disposed toward the heel portion 160 whereas a second set of weight portions may be disposed toward the toe portion 150. In particular, the first set of weight portions may form a cluster of weight portions at or proximate to the heel portion 160 according to the configuration of the third set of weight ports 1710. The weight portions 405, 410, 415, 420, 425, 430, and 435 may define the first set of weight portions and may be disposed in weight ports 925, 930, 935, 940, 945, 950, and 955, respectively. The weight portions 440, 445, 450, 455, 460, 465, 470, 475, and 480 may define the second set of weight portions and may be disposed in weight ports 905, 910, 915, 920, 960, 965, 970, 975, and 980, respectively. The third weight configuration 1700 may be associated with a third launch trajectory profile 1430 (FIG. 14). In particular, the third weight configuration 1700 may allow an individual to turn over the golf club head 100 relatively easier (i.e., square up the face portion 175 to impact a golf ball). By placing the relatively heavier weight portions (i.e., the first set of weight portions) towards the heel portion 160 of the golf club head 100, the center of gravity (GC) of the golf club head 100 may move relatively closer to the axis of the shaft.

Figure 18:
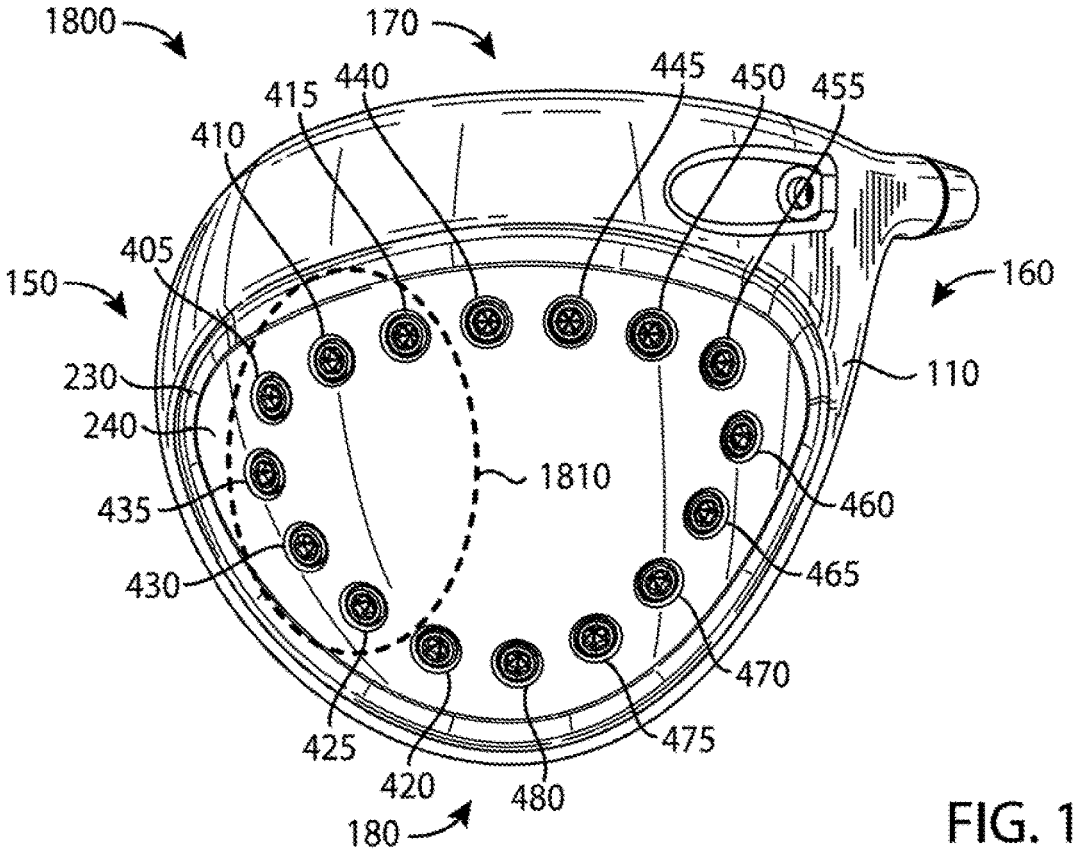
FIG. 18 depicts a fourth weight configuration of the example weight portions.
Figure 19:
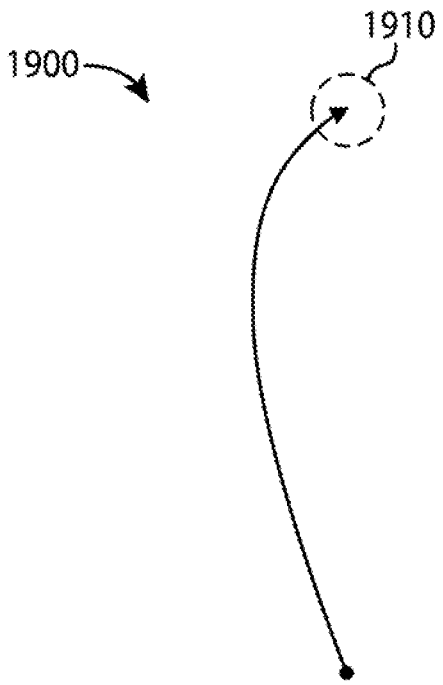
FIG. 19 depicts an example launch trajectory profile of the example golf club head of FIG. 18.

Turning to FIG. 18, for example, a fourth weight configuration 1800 may be associated with a configuration of a fourth set of weight ports 1810. In a fourth weight configuration 1800, for example, a first set of weight portions may be disposed toward the toe portion 150 whereas a second set of weight portions may be disposed toward the heel portion 160. In particular, the first set of weight portions may form a cluster of weight portions at or proximate to the toe portion 150 according to the configuration of the fourth set of weight ports 1810. The weight portions 405, 410, 415, 420, 425, 430, and 435 may define the first set of weight portions and may be disposed in weight ports 905, 910, 915, 965, 970, 975, and 980, respectively. The weight portions 440, 445, 450, 455, 460, 465, 470, 475, and 480 may define the second set of weight portions and may be disposed in weight ports 920, 925, 930, 935, 940, 945, 950, 955, and 960, respectively. The fourth weight configuration 1800 may be associated with the third launch trajectory profile 1430 (FIG. 14). In particular, the fourth weight configuration 1800 may prevent an individual from turning over the golf club head 100 (i.e., the face portion 175 may be more open to impact a golf ball). By placing the relatively heavier weight portions (i.e., the first set of weight portions) towards the toe portion 150 of the golf club head 100, the center of gravity (GC) of the golf club head 100 may move relatively farther away from the axis of the shaft. The fourth weight configuration 1800 may result in a fade golf shot (as shown in FIG. 19, for example, a trajectory or ball flight in which a golf ball travels to the left of a target 1910 and curving back to the right of the target for a right-handed individual). The apparatus, methods, and articles of manufacture described herein are not limited in this regard.

Figure 20:
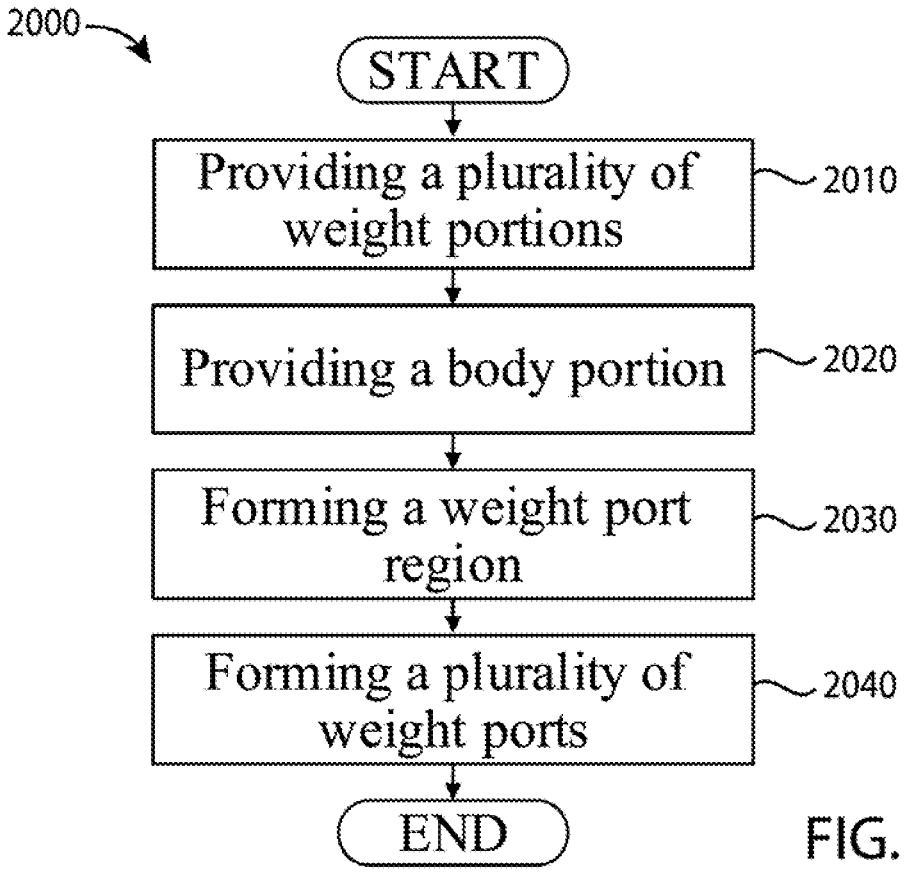
FIG. 20 depicts one manner in which the example golf club heads described herein may be manufactured.

FIG. 20 depicts one manner in which the golf club head 100 may be manufactured. In the example of FIG. 20, the process 2000 may begin with providing a plurality of weight portions (block 2010). The plurality of weight portions may include a first set of weight portions and a second set of weight portions. Each weight portion of the first set of weight portions may be associated with a first mass whereas each weight portion of the second set of weight portions may be associated with a second mass. The first mass may be greater than the second mass. In one example, each weight portion of the first set of weight portions may be made of a tungsten-based material with a mass 2.6 grams whereas each weight portion of the second set of weight portions may be made of an aluminum-based material with a mass of 0.4 grams. The first set of weight portions may have a gray color or a steel color whereas the second set of weight portions may have a black color.

The process 2000 may provide a body portion of a golf club head (block 2020). The body portion may include a front portion, a rear portion, a toe portion, a heel portion, a top portion, a bottom portion having an outer surface associated with outer surface curve, and a skirt portion between the top and bottom portion.

The process 2000 may form a weight port region located at or proximate to the bottom and skirts portions (block 2030). A transition region may surround the weight port region.

The process 2000 may form a plurality of weight ports along a periphery of the weight port region (block 2040). Each weight port of the plurality of weight ports may be associated with a port diameter and configured to receive at least one weight portion of the plurality of weight portions. Two adjacent weight ports may be separated by less than or equal to the port diameter. Further, each weight port of the plurality of weight ports may be associated with a port axis. The port axis may be perpendicular or substantially perpendicular relative to a tangent plane of the outer surface curve of the bottom portion of the golf club head.

The example process 2000 of FIG. 20 is merely provided and described in conjunction with FIGS. 1-19 as an example of one way to manufacture the golf club head 100. While a particular order of actions is illustrated in FIG. 20, these actions may be performed in other temporal sequences. For example, two or more actions depicted in FIG. 20 may be performed sequentially, concurrently, or simultaneously. Although FIG. 20 depicts a particular number of blocks, the process may not perform one or more blocks. The apparatus, methods, and articles of manufacture described herein are not limited in this regard.

Figure 4:
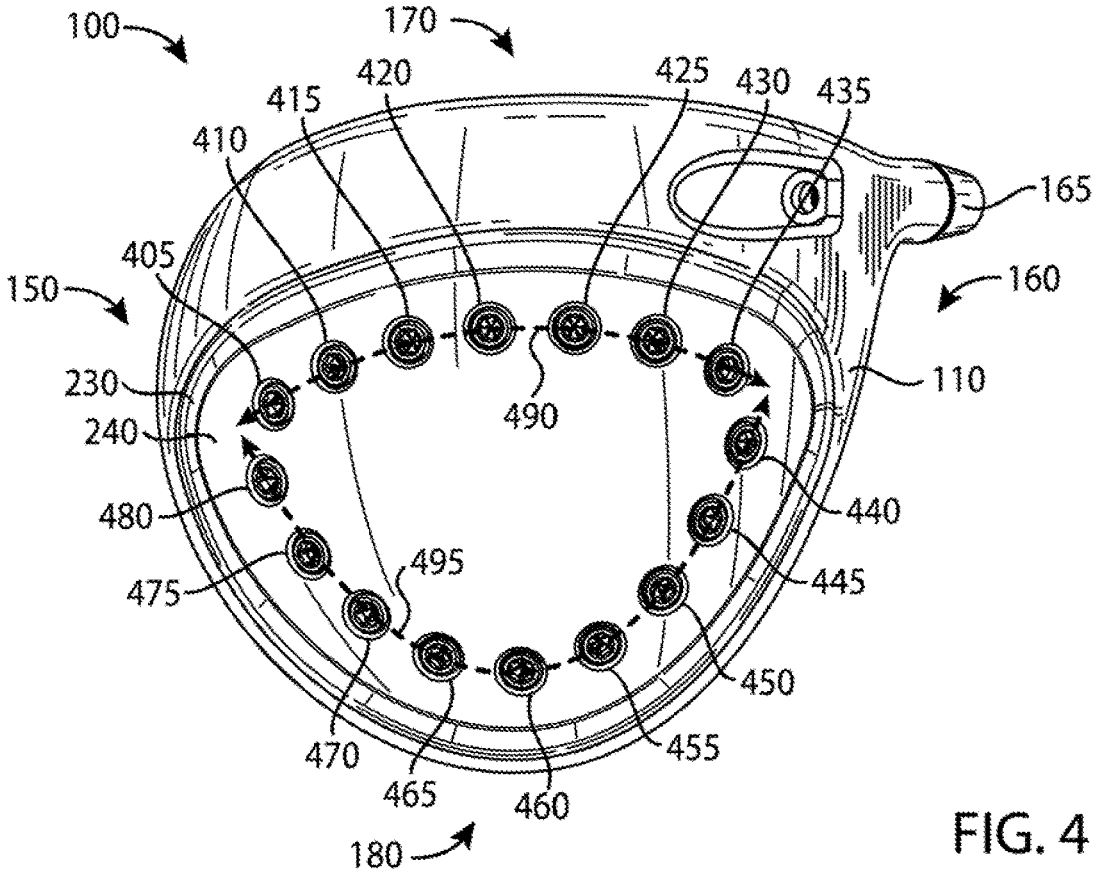
FIG. 4 depicts a bottom view of the example golf club head of FIG. 1.
Figure 5:
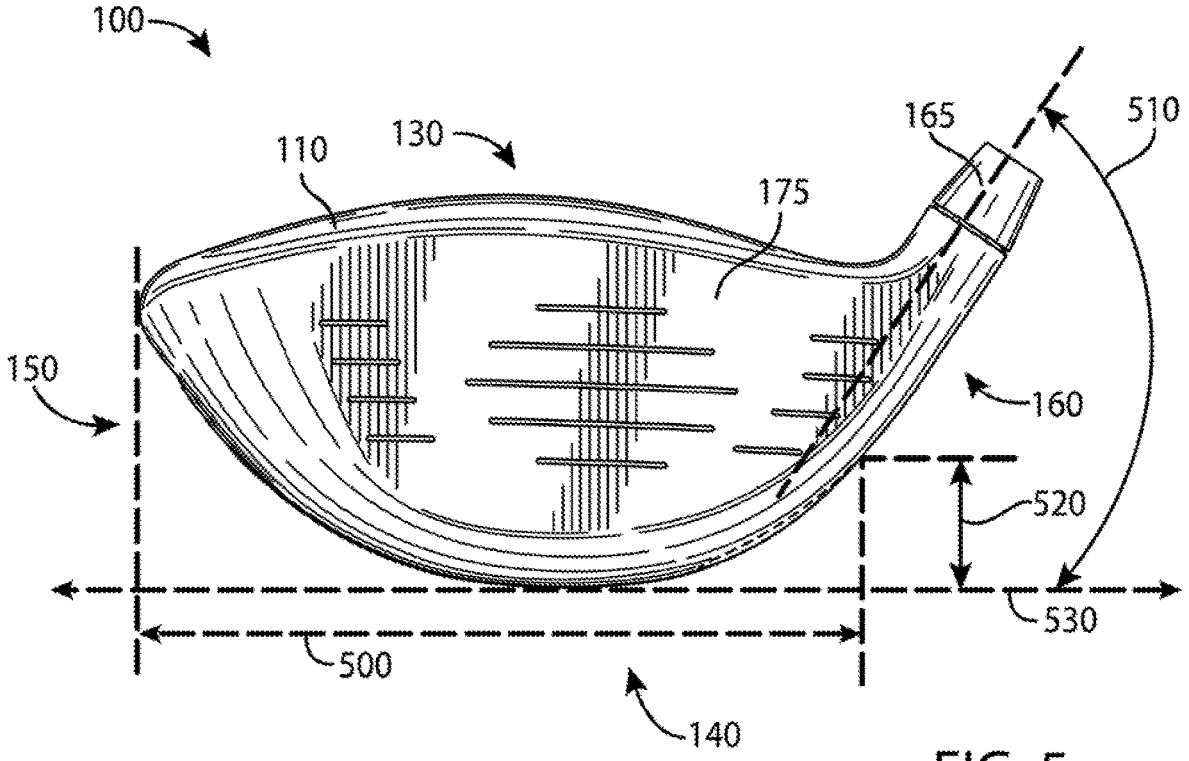
FIG. 5 depicts a front view of the example golf club head of FIG. 1.
Figure 6:
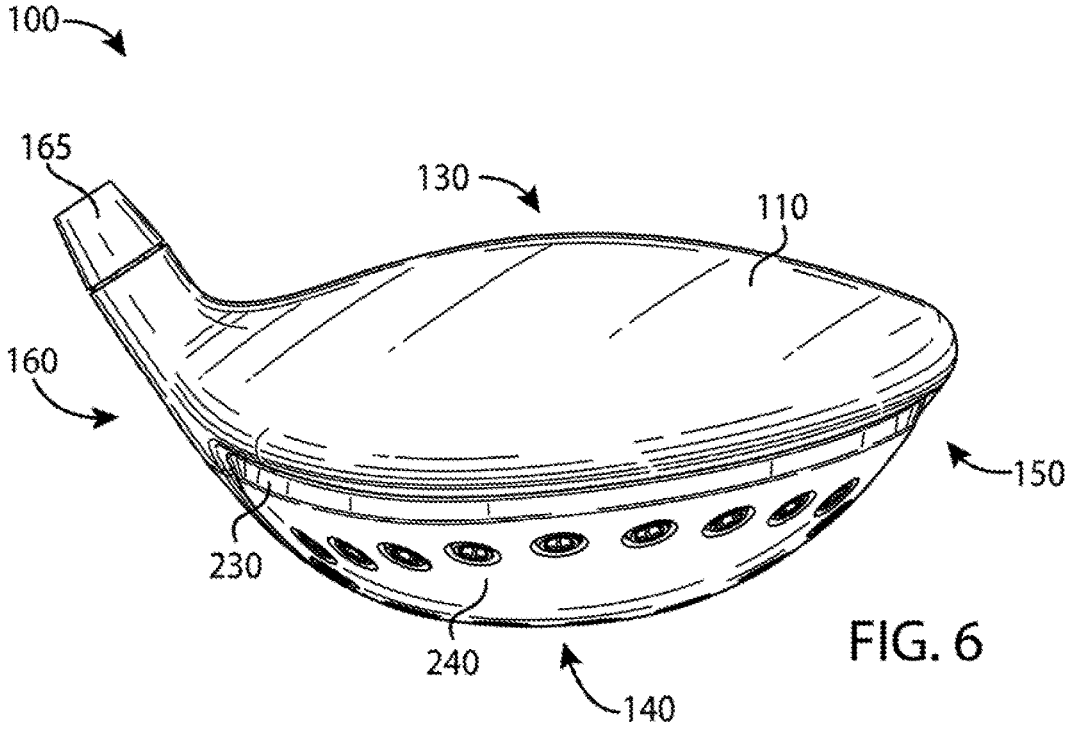
FIG. 6 depicts a rear view of the example golf club head of FIG. 1.
Figure 7:
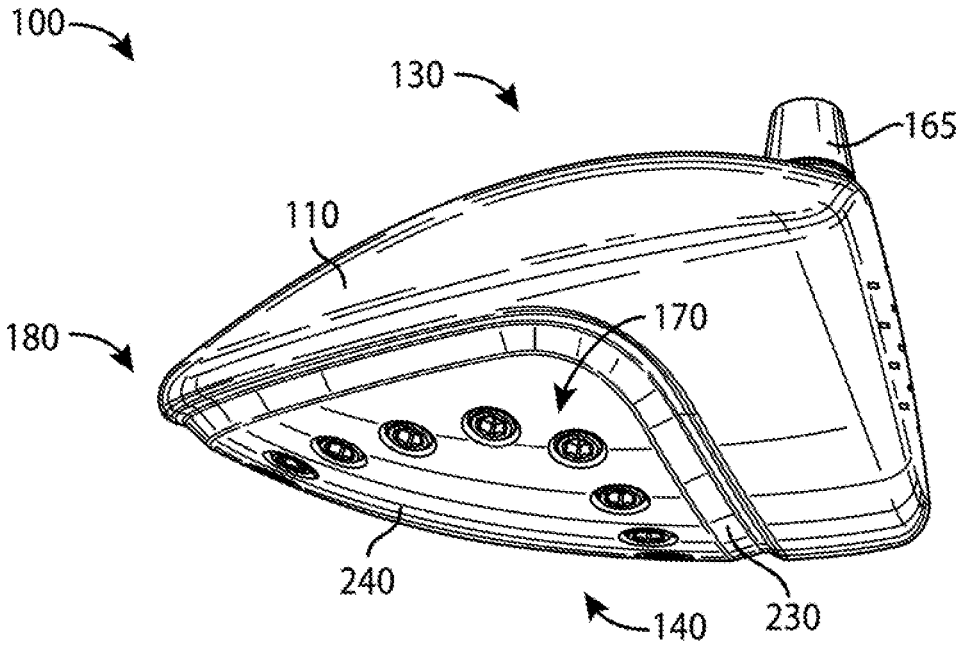
FIG. 7 depicts a toe view of the example golf club head of FIG. 1.
Figure 8:
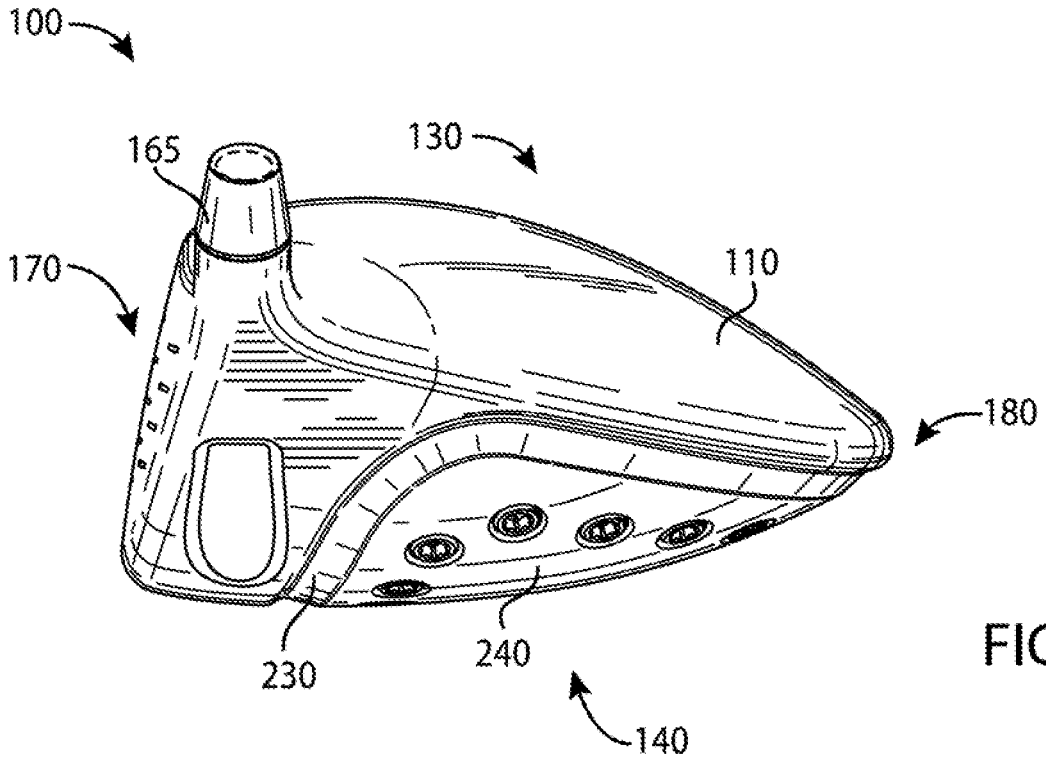
FIG. 8 depicts a heel view of the example golf club head of FIG. 1.

As shown in the above examples, the plurality of weight portions 120 and the plurality of weight ports 900 may be located on a periphery of the weight port region 240 along a path that defines a generally D-shaped loop formed with two arcs, generally shown as 490 and 495 in FIG. 4. For example, the weight portions 405, 410, 415, 420, 425, 430, and 435 (FIG. 4), and the weight ports 905, 910, 915, 920, 925, 930, and 935 (FIG. 9) may form the first arc 490. In particular, the first arc 490 may extend between the toe and heel portions 150 and 160, respectively, across the bottom portion 140. The weight portions 440, 445, 450, 455, 460, 465, 470, 475, and 480 (FIG. 4), the weight ports 940, 945, 950, 955, 960, 965, 970, 975, and 980 (FIG. 9) may form the second arc 495. The second arc 495 may generally follow the contour of the rear portion 180 of the body portion 110. Alternatively, the first and second arcs 490 and 495 may define loops with other shapes that extend across the bottom portion 140 (e.g., a generally O-shaped loop). The apparatus, methods, and articles of manufacture described herein are not limited in this regard.

Figure 21:
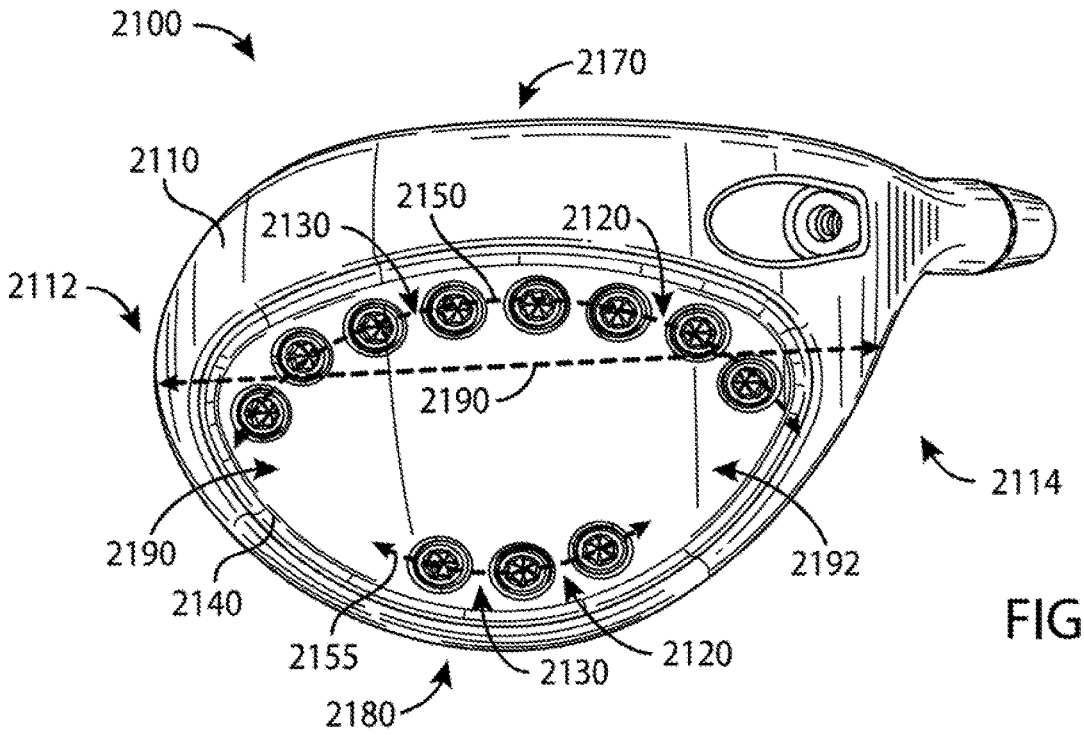
FIG. 21 depicts a bottom view of another example golf club head.

Although the above examples may depict the plurality of weight portions 120 and the plurality of weight ports 900 forming a particular geometric shape, the apparatus, methods, and articles of manufacture described herein may have weight portions and weight ports located along a periphery of a weight portion region to form other geometric shapes. Turning to FIG. 21, for example, a golf club head 2100 may include a bottom portion 2110, and a plurality of weight portions 2120 disposed in a plurality of weight ports 2130. The plurality of weight ports 2130 may be located along a periphery of a weight port region 2140 of the bottom portion 2110 (i.e., the plurality of weight ports 2130 may extend between the toe and heel portions 2112 and 2114, respectively, across the bottom portion 2110). In contrast to the plurality of weight portions 120 and the plurality of weight ports 900 (e.g., FIGS. 4 and 9), the plurality of weight ports 2130 may form two discrete arcs, generally shown as 2150 and 2155, extending across the bottom portion 2110. The plurality of weight ports 2130 may extend more than 50% of a maximum toe-to-heel distance 2190 of the golf club head 2100. The apparatus, methods, and articles of manufacture are not limited in this regard.

Figure 22:
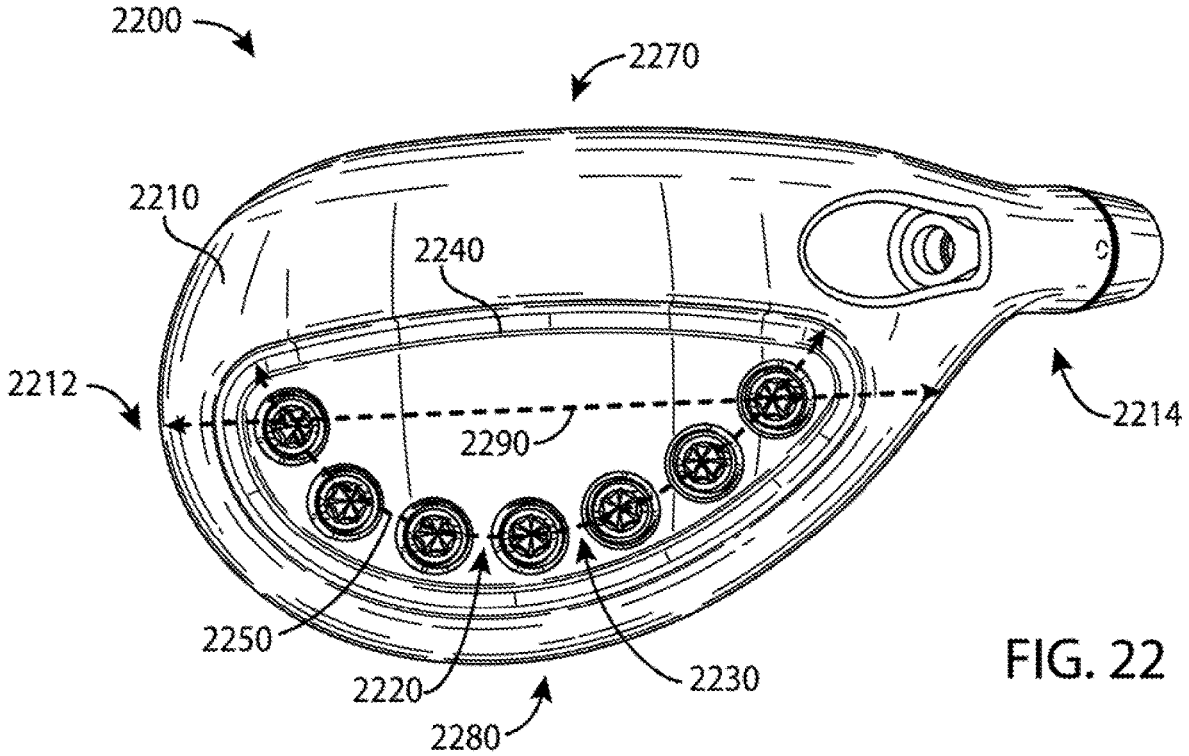
FIG. 22 depicts a bottom view of yet another example golf club head.

As illustrated in FIG. 22, for example, a golf club head 2200 may include a bottom portion 2210, and a plurality of weight portions 2220 disposed in a plurality of weight ports 2230. The plurality of weight ports 2230 located along a periphery of a weight port region 2240 may be arranged along a path that defines an arc, generally shown as 2250, extending across the bottom portion 2210 (i.e., the plurality of weight ports 2230 may extend between the toe and heel portions, 2212 and 2214 across the bottom portion 2210). The plurality of weight ports 2230 may extend more than 50% of a maximum toe-to-heel distance 2290 of the golf club head 2200. The apparatus, methods, and articles of manufacture are not limited in this regard.

Figure 23:
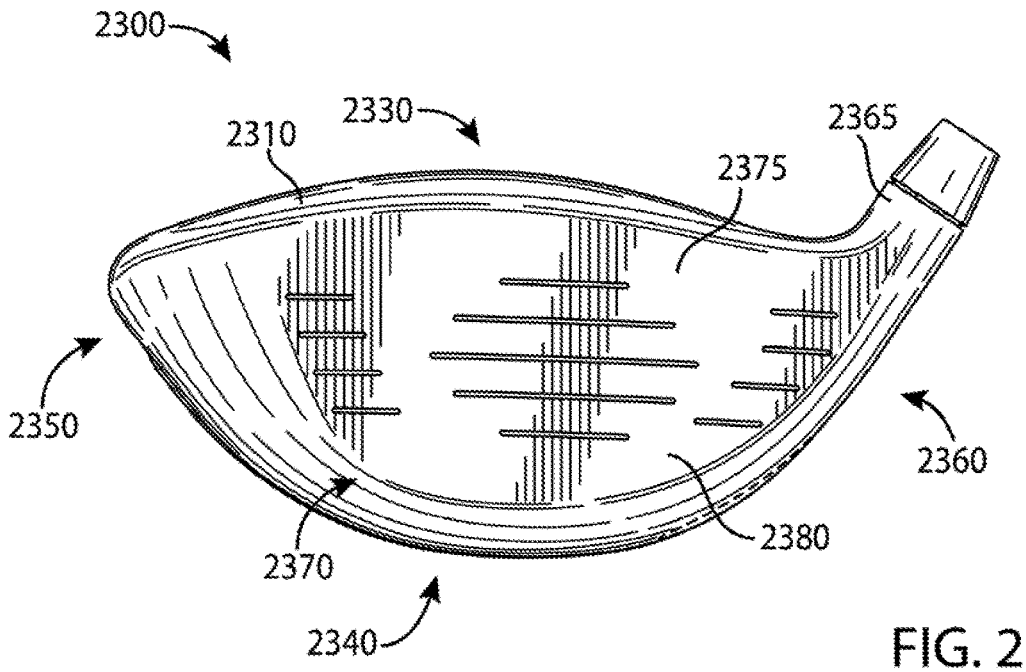
FIG. 23 depicts a front view of yet another example golf club head.
Figure 24:
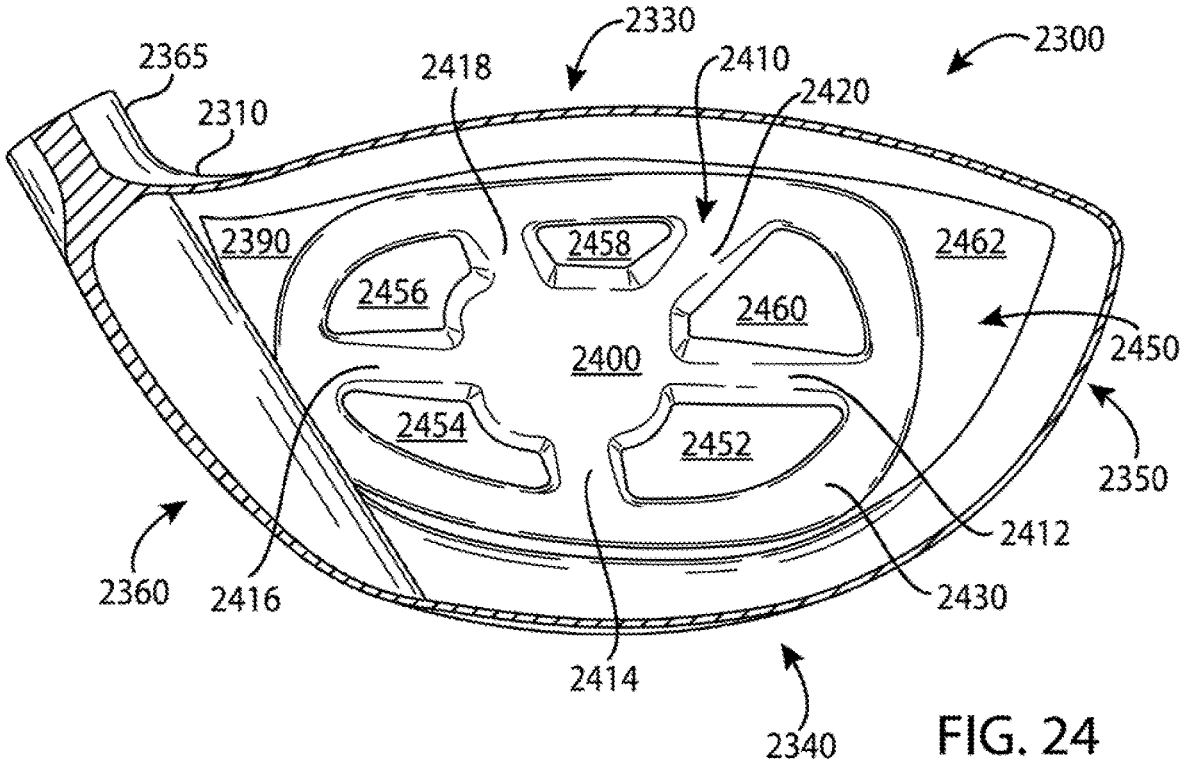
FIG. 24 depicts a cross-sectional view of an example face portion of the example golf club head of FIG. 23.

A golf club head according to the examples described herein may have a face portion with varying thickness or any type of thickness profile. In the example of FIGS. 23 and 24, a golf club head 2300 may include a body portion 2310, which may include a top portion 2330, a bottom portion 2340, a toe portion 2350, a heel portion 2360, a front portion 2370, and a rear portion (not shown). The body portion 2310 may also include a hosel portion 2365 to receive a shaft (not shown). Alternatively, the body portion 2310 may include a bore instead of the hosel portion 2365. The bottom portion 2340 may include one or more weight port regions (not shown), with each weight port region having a plurality of weight ports (not shown) configured to receive a plurality of weight portions (not shown). The weight port regions, weight ports and/or the weight portions may be similar in many respects to the weight port regions, weigh ports, and weight portions described herein (e.g., as described in the above examples). Alternatively, the bottom portion 2340 may not have any weight port regions with weight ports and/or weight portions. The apparatus, methods, and articles of manufacture described herein are not limited in this regard.

The body portion 2310 may be made partially or entirely of an aluminum-based material, a magnesium-type material, a steel-based material, a titanium-based material, any combination thereof, or any other suitable material. In another example the body portion 2310 may be made partially or entirely of a non-metal material such as a ceramic material, a composite material, any combination thereof, or any other suitable material.

The golf club head 2300 may have a club head volume greater than or equal to 300 cubic centimeters ($cm^3$ or cc). In one example, the golf club head 2300 may be about 460 cc. Alternatively, the golf club head 2300 may have a club head volume less than or equal to 300 cc. In particular, the golf club head 2300 may have a club head volume between 100 cc and 200 cc. The club head volume of the golf club head 2300 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 2300. Although FIG. 23 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). The apparatus, methods, and articles of manufacture described herein are not limited in this regard.

The front portion 2370 may include a face portion 2375 having an outer side 2380, which may be also the strike face of the face portion 2375, and an inner side 2390. Portions of the face portion 2375 may have constant or varying thicknesses between the top portion 2330 and the bottom portion 2340 and/or between the toe portion 2350 and the heel portion 2360 as described herein. The smallest thickness of the face portion 2375 may be referred to herein as the face portion thickness ($T_{FP}$). In one example, the face portion thickness may be between 0.03 inch (0.762 cm) and 0.12 inch (0.305 cm) ($0.03<T_{FP}<0.12$). In another example, the face portion thickness may be between 0.04 inch (0.102 cm) and 0.1 inch (0.254 cm) ($0.04<T_{FP}<0.1$). In yet another example, the face portion thickness may be between 0.05 inch (0.127 cm) and 0.09 inch (0.229 cm) ($0.05<T_{FP}<0.09$). The apparatus, methods, and articles of manufacture described herein are not limited in this regard.

As illustrated in FIG. 24, for example, the inner side 2390 may include a center portion 2400 having a first thickness ($T_1$), which may be generally defined as the thickness of the face portion 2375 at or near the impact area of the face portion 2375. The impact area of the face portion 2375 may be defined as a central strip down the middle of the face portion 2375 having a width of 1.68 inches (4.27 cm). The center portion 2400 may be within the impact area of the face portion 2375. Accordingly, in one example, the center portion 2400 may have a radius of less than or equal to about 0.84 inch (2.144 cm). The radius of the center portion may refer to the largest distance from a geometric center of the center portion 2400 to the boundary of the center portion 2400 with the center portion having any symmetrical or asymmetrical shape. In another example, the center portion 2400 may have a radius of less than or equal to about 0.7 inch (1.778 cm). In yet another example, the center portion 2400 may have a radius of less than or equal to about 0.6 inch (1.524 cm). In yet another example, the center portion 2400 may have a radius of less than or equal to about 0.5 inch (1.27 cm). In yet another example, the center portion 2400 may have a radius of less than or equal to about 0.4 inch (1.27 cm). In yet another example, the center portion 2400 may have a radius that is generally similar to the radius of a golf ball (not shown). Alternatively, the center portion 2400 may be larger than the impact area. Further, portions of the center portion 2400 may extend outside the impact area while other portions of the center portion 2400 may be within the impact area. The apparatus, methods, and articles of manufacture described herein are not limited in this regard.

The first thickness may be greater than the face portion thickness (T1>TFP). The center portion 2400 may be located generally at impact area of the face portion 2375 or on an area of the face portion 2375 that is used to strike a golf ball (not shown). The center portion 2400 may be offset relative to the geometric center of the face portion 2375 toward the top portion 2330, the bottom portion 2340, the toe portion 2350, or the heel portion 2360. The center portion 2400 may have any shape. For example, the center portion 2400 may be generally one or a combination of a square shape, a rectangular shape, a triangular shape, a circular shape, an elliptical shape, a pentagonal shape, a hexagonal shape, a polygonal shape, or a star shape. The apparatus, methods, and articles of manufacture described herein are not limited in this regard.

The inner side 2390 of the face portion 2375 may include a plurality of inner wall portions 2410, which are generally shown in FIG. 24 as inner wall portions 2412, 2414, 2416, 2418 and 2420. Accordingly, in the example of FIG. 24, the body portion 2310 includes five inner wall portions 2410 (i.e., first to fifth inner wall portions). A wall portion (e.g., inner wall portion or outer wall portion) as described herein may define a portion or a region of the inner side 2390 of the face portion 2375 that projects from the inner side 2390 of the face portion 2375 into the body portion 2310. In other words, a wall portion as described herein may define a portion or a region of the face portion 2375 that has a greater thickness than the face portion thickness ($T_{FP}$). The inner side 2390 may include any number of inner wall portions 2410. The inner wall portions 2410 may extend from the center portion 2400 to an outer wall portion 2430 on the inner side 2390. The inner wall portions 2410 may be connected to the center portion 2400 and/or connected to the outer wall portion 2430. The inner wall portions 2410 may extend from the center portion 2400 to the outer wall portion 2430 in any configuration (i.e., in any orientation, angle, spacing between adjacent inner wall portions, etc.).

For example, the inner wall portion 2412 may extend from the center portion 2400 toward the toe portion 2350. The inner wall portion 2414 may extend from the center portion 2400 toward the bottom portion 2340. The inner wall portion 2416 may extend from the center portion 2400 toward the heel portion 2360. The inner wall portion 2418 may extend from the center portion 2400 toward the top portion 2330 and the heel portion 2360. The inner wall portion 2420 may extend from the center portion 2400 toward the top portion 2330 and the toe portion 2350.

Further, the inner wall portions 2410 may vary in width. In one example, the width of any of the inner wall portions 2410 may be between about 0.1 inch (0.254 cm) and about 0.75 inch (1.905 cm). In another example, the width of any or the inner wall portion 2410 may be between about 0.2 inch (0.508 cm) and about 0.5 inch (1.27 cm). The inner wall portions 2410 may also vary in cross-sectional shape. In one example, one or more of the inner wall portions may have a rectangular cross-sectional shape. In another example, one or more of the inner wall portions may have an elliptical cross-sectional shape. In yet another example, one or more of the inner wall portions may have a trapezoidal cross-section shape. Alternatively, the cross-sectional configuration and/or the width of each inner wall portion may vary between the center portion 2400 and the outer wall portion 2430. The apparatus, methods, and articles of manufacture described herein are not limited in this regard.

The outer wall portion 2430 may have a second thickness ($T_2$) that may be less than the first thickness ($T_2<T_1$) but greater than the face portion thickness ($T_{FP}$). However, the thickness of the outer wall portion 2430 may vary. The second thickness may be generally defined as the thickness of the face portion 2375 at or near the outer wall portion 2430. The outer wall portion 2430 may at least partially surround the center portion 2400. In the example of FIG. 24, the outer wall portion 2430 resembles a loop that surrounds the center portion 2400. In one example, the first thickness may be between about 0.1 inches (0.25 cm) and about 0.2 (0.50 cm) inches ($0.1<T_1<0.2$), and the second thickness may be between 0.05 inches (0.13 cm) and 0.15 inches (0.38 cm). In another example, the first thickness may be between about 0.125 inches (0.32 cm) and about 0.175 inches (0.44 cm), and the second thickness may be between about 0.075 inches (0.19 cm) and about 0.125 inches (0.32 cm). The apparatus, methods, and articles of manufacture described herein are not limited in this regard.

Between the center portion 2400, the inner wall portions 2410 and the outer wall portion 2430, the inner side 2390 of the face portion 2375 may include back portion regions 2450, which are generally shown as back portion regions 2452, 2454, 2456, 2458, 2460, and 2462. Each of the back portion regions 2452, 2454, 2456, 2458, and 2460 may be bound by the center portion 2400, two adjacent inner wall portions 2410 and a corresponding portion of the outer wall portion 2430. The back portion region 2462 may surround the outer wall portion 2430. The back portion regions 2450 may have the same thickness or have different thicknesses. The back portion regions 2450 may have a third thickness ($T_3$), which may be less than the first thickness ($T_3<T_1$) and less than the second thickness ($T_3<T_2$). The third thickness may be generally defined as the thickness of the face portion 2375 at or near the back portion regions 2450. In one example, the thickness of any of the back portion regions 2450 may be the same as the face portion thickness ($T_{FP}$). In one example, the back portion regions 2450 may have a third thickness of between about 0.03 inches (0.762 cm) and about 0.14 inch (0.36 cm). In another example, the back portion regions 2450 may have a third thickness of between about 0.05 inch (0.127 cm) and about 0.12 inches (0.30 cm). In another example, the back portion regions 2450 may have a similar thickness as the face portion thickness. The apparatus, methods, and articles of manufacture described herein are not limited in this regard.

Each of the inner wall portions 2410 may have a constant thickness or variable thickness. In one example, the thickness of each of the inner wall portions 2410 may transition from the first thickness ($T_1$) to the second thickness ($T_2$) in a direction from the center portion 2400 to the outer wall portion 2430 as the inner wall portion 2410 extends from the center portion 2400 to the outer wall portion 2430. Accordingly, the thickness of each inner wall portion 2410 may be similar to the first thickness ($T_1$) at the connection region between the inner wall portion 2410 and the center portion 2400, and the thickness of each inner wall portion 2410 may be similar to the second thickness ($T_2$) at the connection region between the inner wall portion 2410 and the outer wall portion 2430. The apparatus, methods, and articles of manufacture described herein are not limited in this regard.

According to the examples described herein and shown in FIG. 24, the face portion 2375 may include a first region that is also referred to as the center portion 2400 at or proximate to the impact area of the face portion 2375 and has a first thickness $T_1$ that is greater than the face portion thickness. The face portion 2375 may include a second region that is also referred to herein as the outer wall portion 2430, which at least partially surrounds the first region and has a second thickness $T_2$ that is less than the first thickness $T_1$. The face portion 2375 may include a plurality of third regions that are also referred to as the inner wall portions 2410 and have a constant or variable thickness of less than or equal to the first thickness $T_1$ and greater than or equal to the second thickness $T_2$. The face portion 2375 may include a plurality of fourth regions that are also referred to herein as the back portion regions 2450 and have a third thickness $T_3$ of less than the first thickness $T_1$ and the second thickness $T_2$, or alternatively, have a third thickness $T_3$ that is similar to the face portion thickness ($T_{FP}$). The back portion region 2462 may be referred to herein as a fifth region that has the third thickness $T_3$ and surrounds the second region or the outer wall portion 2430. Thus, the face portion 2375 includes a plurality of regions having different thicknesses configured as described herein. The apparatus, methods, and articles of manufacture described herein are not limited in this regard.

Figure 25:
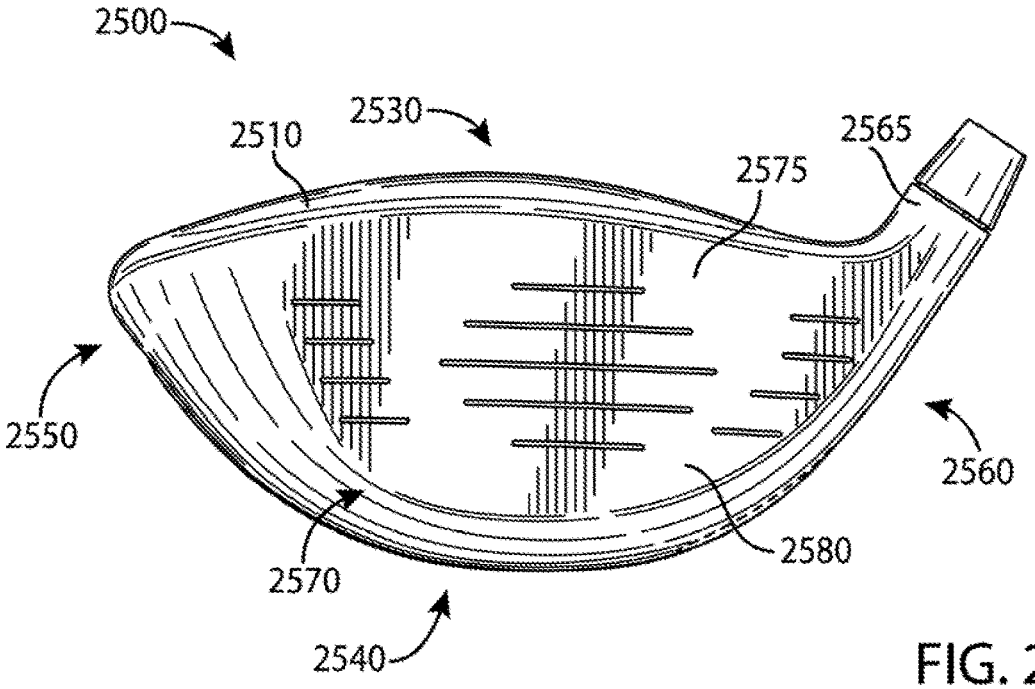
FIG. 25 depicts a front view of another example golf club head.
Figure 26:
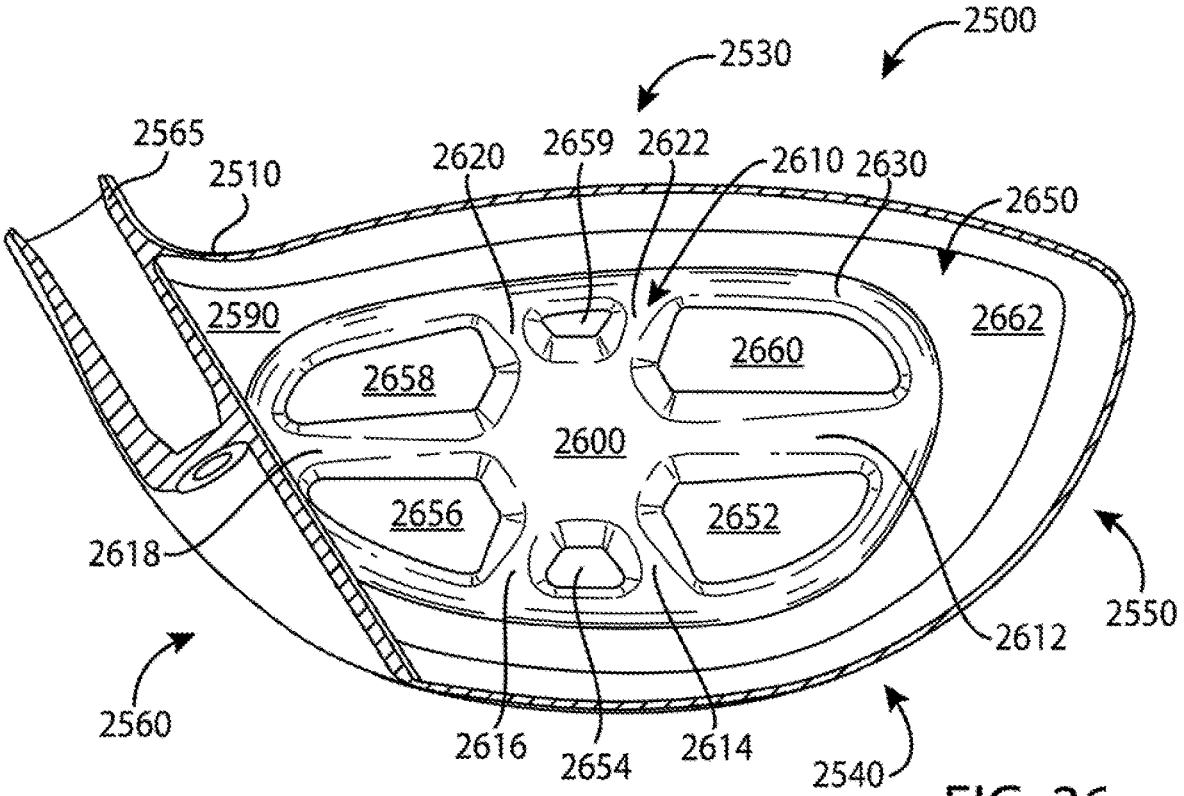
FIG. 26 depicts a cross-sectional view of an example face portion of the example golf club head of FIG. 25.

In the example of FIGS. 25 and 26, a golf club head 2500 may include a body portion 2510, which may include a top portion 2530, a bottom portion 2540, a toe portion 2550, a heel portion 2560, a front portion 2570, and a rear portion (not shown). The body portion 2510 may also include a hosel portion 2565 to receive a shaft (not shown). Alternatively, the body portion 2510 may include a bore instead of the hosel portion 2565. The bottom portion 2540 may include one or more weight port regions (not shown), with each weight port region having a plurality of weight ports (not shown) configured to receive a plurality of weight portions (not shown). The weight port regions, weight ports and/or the weight portions may be similar in many respects to the weight port regions, weigh ports and weight portions described herein (e.g., as described in the above examples). Alternatively, the bottom portion 2540 may not have any weight port regions with weight ports and/or weight portions. The apparatus, methods, and articles of manufacture described herein are not limited in this regard.

The body portion 2510 may be made partially or entirely of an aluminum-based material, a magnesium-type material, a steel-based material, a titanium-based material, any combination thereof, or any other suitable material. In another example the body portion 2510 may be made partially or entirely of a non-metal material such as a ceramic material, a composite material, any combination thereof, or any other suitable material.

The golf club head 2500 may have a club head volume greater than or equal to 300 cubic centimeters ($cm^3$ or cc). In one example, the golf club head 2500 may be about 460 cc. Alternatively, the golf club head 2500 may have a club head volume less than or equal to 300 cc. In particular, the golf club head 2500 may have a club head volume between 100 cc and 200 cc. The club head volume of the golf club head 2500 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 2500. Although FIG. 25 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). The apparatus, methods, and articles of manufacture described herein are not limited in this regard.

The front portion 2570 may include a face portion 2575 having an outer side 2580, which may be also the strike face of the face portion 2575, and an inner side 2590. Portions of the face portion 2575 may have constant or varying thicknesses between the top portion 2530 and the bottom portion 2540 and/or between the toe portion 2550 and the heel portion 2560 as described herein. The smallest thickness of the face portion 2575 may be referred to herein as the face portion thickness ($T_{FP}$). In one example, the face portion thickness may be between 0.03 inch (0.762 cm) and 0.12 inch (0.305 cm) ($0.03<T_{FP}<0.12$). In another example, the face portion thickness may be between 0.04 inch (0.102 cm) and 0.1 inch (0.254 cm) ($0.04<T_{FP}<0.1$). In yet another example, the face portion thickness may be between 0.05 inch (0.127 cm) and 0.09 inch (0.229 cm) ($0.05<T_{FP}<0.09$). The apparatus, methods, and articles of manufacture described herein are not limited in this regard.

As illustrated in FIG. 26, for example, the inner side 2590 may include a center portion 2600 having a first thickness ($T_1$), which may be generally defined as the thickness of the face portion 2575 at or near the impact area of the face portion 2575. The impact area of the face portion 2575 may be defined as a central strip down the middle of the face portion 2575 having a width of about 1.68 inches (4.27 cm). The center portion 2400 may be within the impact area of the face portion 2575. Accordingly, in one example, the center portion 2600 may have a radius of less than or equal to about 0.84 inch (2.144 cm). The radius of the center portion may refer to the largest distance from a geometric center of the center portion 2600 to the boundary of the center portion 2600 with the center portion having any symmetrical or asymmetrical shape. In another example, the center portion 2600 may have a radius of less than or equal to about 0.7 inch (1.778 cm). In yet another example, the center portion 2600 may have a radius of less than or equal to about 0.6 inch (1.524 cm). In yet another example, the center portion 2600 may have a radius of less than or equal to about 0.5 inch (1.27 cm). In yet another example, the center portion 2600 may have a radius of less than or equal to about 0.4 inch (1.27 cm). In yet another example, the center portion 2600 may have a radius that is generally similar to the radius of a golf ball (not shown). Alternatively, the center portion 2600 may be larger than the impact area. Further, portions of the center portion 2600 may extend outside the impact area while other portions of the center portion 2600 may be within the impact area. The apparatus, methods, and articles of manufacture described herein are not limited in this regard.

The first thickness may be greater than the face portion thickness ($T_1>T_{FP}$). The center portion 2600 may be located generally at the impact area of the face portion 2575 or on an area of the face portion 2575 that is used to strike a golf ball (not shown). The center portion 2600 may be offset relative to the geometric center of the face portion 2575 toward the top portion 2530, the bottom portion 2540, the toe portion 2550, or the heel portion 2560. The center portion 2600 may have any shape. For example, the center portion 2600 may be generally one or a combination of a square shape, a rectangular shape, a triangular shape, a circular shape, an elliptical shape, a pentagonal shape, a hexagonal shape, a polygonal shape, or a star shape. The apparatus, methods, and articles of manufacture described herein are not limited in this regard.

The inner side 2590 of the face portion 2575 may include a plurality of inner wall portions 2610, which are generally shown in FIG. 26 as inner wall portions 2612, 2614, 2616, 2618, 2620 and 2622. Accordingly, in the example of FIG. 26, the body portion 2510 includes six inner wall portions 2610 (i.e., first to sixth inner wall portions). A wall portion (e.g., inner wall portion or outer wall portion) as described herein may define a portion or a region of the inner side 2590 of the face portion 2575 that projects from the inner side 2590 of the face portion 2575 into the body portion 2510. In other words, a wall portion as described herein may define a portion or a region of the face portion 2575 that has a greater thickness than the face portion thickness. The inner side 2590 may include any number of inner wall portions 2610. The inner wall portions 2610 may extend from the center portion 2600 to an outer wall portion 2630 on the inner side 2590. The inner wall portions 2610 may be connected to the center portion 2600 and/or connected to the outer wall portion 2630. The inner wall portions 2610 may extend from the center portion 2600 to the outer wall portion 2630 in any configuration (i.e., in any orientation, angle, spacing between adjacent inner wall portions, etc.).

For example, the inner wall portion 2612 may extend from the center portion 2600 toward the toe portion 2550. The inner wall portion 2614 may extend from the center portion 2600 toward the bottom portion 2540 and the toe portion 2550. The inner wall portion 2616 may extend from the center portion 2600 toward the bottom portion 2540 and the heel portion 2560. The inner wall portion 2618 may extend from the center portion 2600 toward the heel portion 2560. The inner wall portion 2620 may extend from the center portion 2600 toward the top portion 2530 and the heel portion 2560. The inner wall portion 2622 may extend from the center portion 2600 toward the top portion 2530 and the toe portion 2550.

Further, the inner wall portions 2610 may vary in width. In one example, the width of any of the inner wall portions 2610 may be between about 0.1 inch (0.254 cm) and about 0.75 inch (1.905). In another example, the width of any or the inner wall portion 2610 may be between about 0.2 inch (0.508 cm) and about 0.5 inch (1.27 cm). The inner wall portion 2610 may also vary in cross-sectional shape. In one example, one or more of the inner wall portions may have a rectangular cross-sectional shape. In another example, one or more of the inner wall portions may have an elliptical cross-sectional shape. In yet another example, one or more of the inner wall portions may have a trapezoidal cross-sectional shape. Alternatively, the cross-sectional configuration and/or the width of each inner wall portion may vary between the center portion 2600 and the outer wall portion 2630. The apparatus, methods, and articles of manufacture described herein are not limited in this regard.

The outer wall portion 2630 may have a second thickness ($T_2$) that may be less than the first thickness ($T_2<T_1$) but greater than the face portion thickness. However, the thickness of the outer wall portion 2630 may vary. The second thickness may be generally defined as the thickness of the face portion 2575 at or near the outer wall portion 2630. The outer wall portion 2630 may at least partially surround the center portion 2600. In the example of FIG. 26, the outer wall portion 2630 resembles a loop that surrounds the center portion 2600. In one example, the first thickness may be between about 0.1 inches (0.25 cm) and about 0.2 (0.50 cm) inches ($0.1<T_1<0.2$), and the second thickness may be between 0.05 inches (0.13 cm) and 0.15 inches (0.38 cm). In another example, the first thickness may be between about 0.125 inches (0.32 cm) and about 0.175 inches (0.44 cm), and the second thickness may be between about 0.075 inches (0.19 cm) and about 0.125 inches (0.32 cm). The apparatus, methods, and articles of manufacture described herein are not limited in this regard.

Between the center portion 2600, the inner wall portions 2610 and the outer wall portion 2630, the inner side 2590 of the face portion 2575 may include back portion regions 2650, which are generally shown as back portion regions 2652, 2654, 2656, 2658, 2659, 2660, and 2662. Each of the back portion regions 2652, 2654, 2656, 2658, 2659 and 2660 may be bound by the center portion 2600, two adjacent inner wall portions 2610 and a corresponding portion of the outer wall portion 2630. The back portion region 2662 may surround the outer wall portion 2630. The back portion regions 2650 may have the same thickness or have different thicknesses. The back portion regions 2650 may have a third thickness ($T_3$), which may be less than the first thickness ($T_3<T_1$) and the second thickness ($T_3<T_2$). The third thickness may be generally defined as the thickness of the face portion 2575 at or near the back portion regions 2650. In one example, the thickness of any of the back portion regions 2650 may be the same as the face portion thickness. In one example, the back portion regions 2650 may have a third thickness of between about 0.03 inches (0.762 cm) and about 0.14 inch (0.36 cm). In another example, the back portion regions 2650 may have a third thickness of between about 0.05 inch (0.127 cm) and about 0.12 inches (0.30 cm). In another example, the back portion regions 2650 may have a similar thickness as the face portion thickness. The apparatus, methods, and articles of manufacture described herein are not limited in this regard.

Each of the inner wall portions 2610 may have a constant thickness or variable thickness. In one example, the thickness of each of the inner wall portions 2610 may transition from the first thickness ($T_1$) to the second thickness ($T_2$) in a direction from the center portion 2600 to the outer wall portion 2630 as the inner wall portion 2610 extends from the center portion 2600 to the outer wall portion 2630. Accordingly, the thickness of each inner wall portion 2610 may be similar to the first thickness ($T_1$) at the connection region between the inner wall portion 2610 and the center portion 2600, and the thickness of each inner wall portion 2610 may be similar to the second thickness ($T_2$) at the connection region between the inner wall portion 2610 and the outer wall portion 2630. The apparatus, methods, and articles of manufacture described herein are not limited in this regard.

According to the examples described herein and shown in FIG. 26, the face portion 2575 may include a first region that is also referred to as the center portion 2600 at or proximate to the impact area of the face portion 2575 and has a first thickness $T_1$ that is greater than the face portion thickness. The face portion 2575 may include a second region that is also referred to herein as the outer wall portion 2630, which at least partially surrounds the first region and has a second thickness $T_2$ that is less than the first thickness $T_1$. The face portion 2575 may include a plurality of third regions that are also referred to as the inner wall portions 2610 and have a constant or variable thickness of less than or equal to the first thickness $T_1$ and greater than or equal to the second thickness $T_2$. The face portion 2575 may include a plurality of fourth regions that are also referred to herein as the back portion regions 2650 and have a third thickness $T_3$ of less than the first thickness $T_1$ and the second thickness $T_2$, or alternatively, have the third thickness $T_3$ that is similar to the face portion thickness. The back portion region 2662 may be referred to herein as a fifth region that has the third thickness $T_3$ and surrounds the second region or the outer wall portion 2630. Thus, the face portion 2575 includes a plurality of regions having different thicknesses configured as described herein. The apparatus, methods, and articles of manufacture described herein are not limited in this regard.

Figure 27:
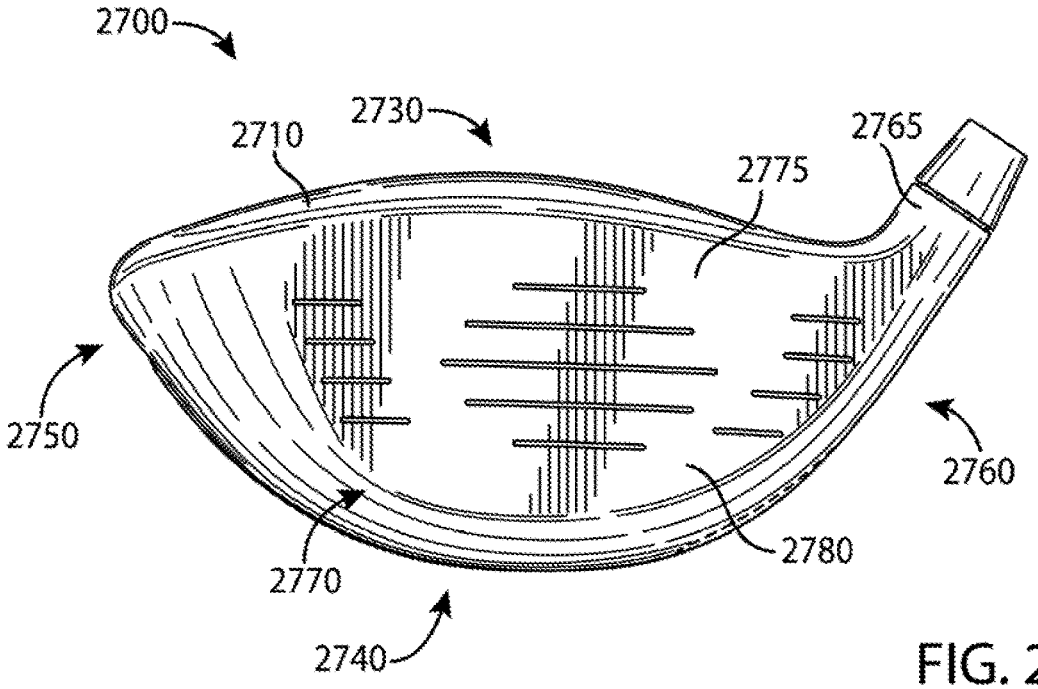
FIG. 27 depicts a front view of another example golf club head.
Figure 28:
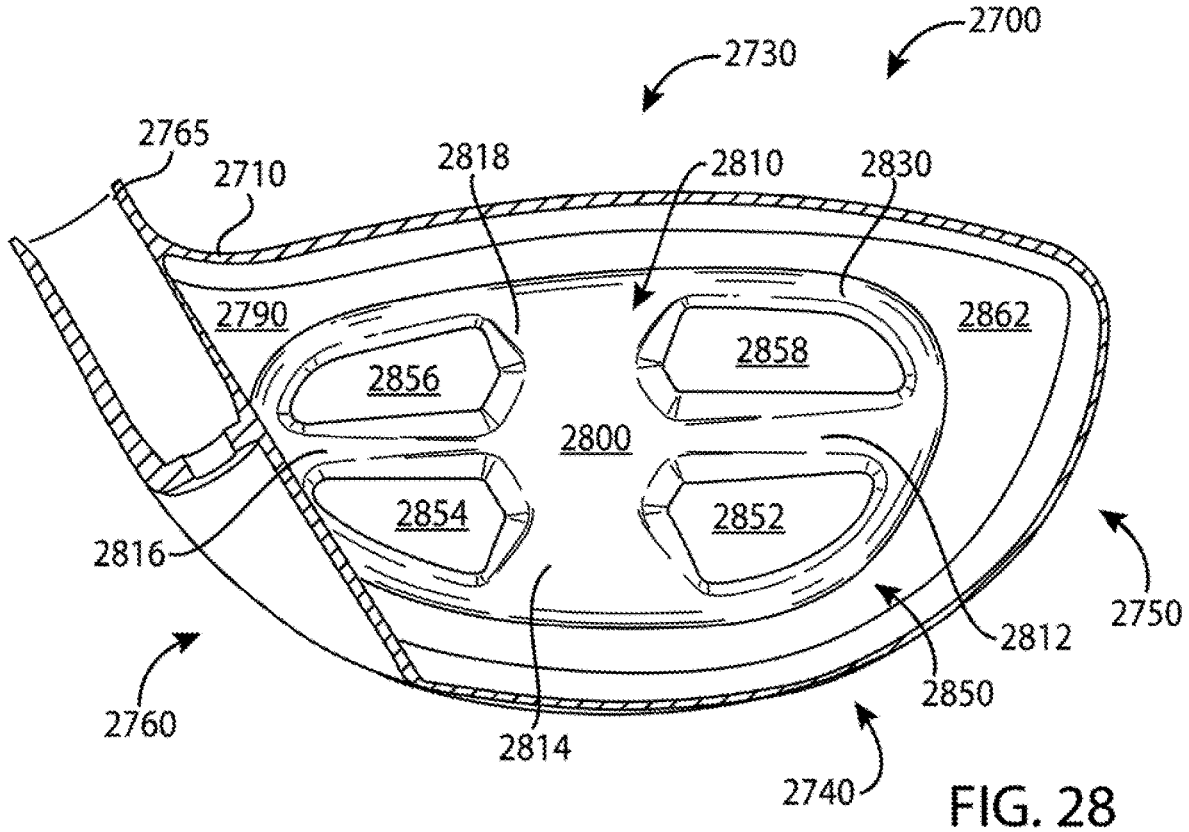
FIG. 28 depicts a cross-sectional view of an example face portion of the example golf club head of FIG. 27.
Figure 29:
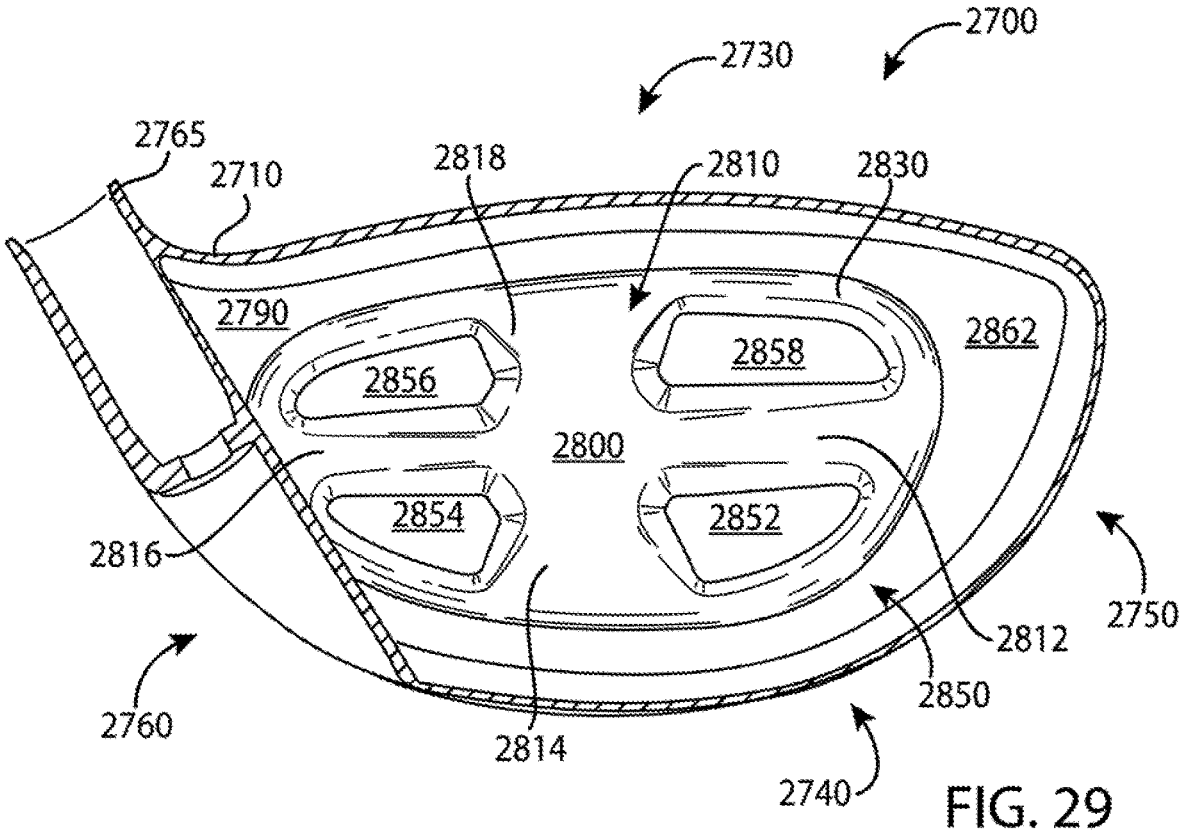
FIG. 29 depicts a cross-sectional view of another example face portion of the example golf club head of FIG. 27.

In the example of FIGS. 27-29, a golf club head 2700 may include a body portion 2710, which may include a top portion 2730, a bottom portion 2740, a toe portion 2750, a heel portion 2760, a front portion 2770, and a rear portion (not shown). The body portion 2710 may also include a hosel portion 2765 to receive a shaft (not shown). Alternatively, the body portion 2710 may include a bore instead of the hosel portion 2765. The bottom portion 2740 may include one or more weight port regions (not shown), with each weight port region having a plurality of weight ports (not shown) configured to receive a plurality of weight portions (not shown). The weight port regions, weight ports and/or the weight portions may be similar in many respects to the weight port regions, weigh ports and weight portions described herein (e.g., as described in the above examples). Alternatively, the bottom portion 2740 may not have any weight port regions with weight ports and/or weight portions. The apparatus, methods, and articles of manufacture described herein are not limited in this regard.

The body portion 2710 may be made partially or entirely of an aluminum-based material, a magnesium-type material, a steel-based material, a titanium-based material, any combination thereof, or any other suitable material. In another example the body portion 2710 may be made partially or entirely of a non-metal material such as a ceramic material, a composite material, any combination thereof, or any other suitable material.

The golf club head 2700 may have a club head volume greater than or equal to 300 cubic centimeters (cm3 or cc). In one example, the golf club head 2700 may be about 460 cc. Alternatively, the golf club head 2700 may have a club head volume less than or equal to 300 cc. In particular, the golf club head 2700 may have a club head volume between 100 cc and 200 cc. The club head volume of the golf club head 2700 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 2700. Although FIG. 27 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). The apparatus, methods, and articles of manufacture described herein are not limited in this regard.

The front portion 2770 may include a face portion 2775 having an outer side 2780, which may be also the strike face of the face portion 2775, and an inner side 2790. Portions of the face portion 2775 may have constant or varying thicknesses between the top portion 2730 and the bottom portion 2740 and/or between the toe portion 2750 and the heel portion 2760 as described herein. The smallest thickness of the face portion 2775 may be referred to herein as the face portion thickness ($T_{FP}$). In one example, the face portion thickness may be between 0.03 inch (0.762 cm) and 0.12 inch (0.305 cm) ($0.03<T_{FP}<0.12$). In another example, the face portion thickness may be between 0.04 inch (0.102 cm) and 0.1 inch (0.254 cm) ($0.04<T_{FP}<0.1$). In yet another example, the face portion thickness may be between 0.05 inch (0.127 cm) and 0.09 inch (0.229 cm) ($0.05<T_{FP}<0.09$). The apparatus, methods, and articles of manufacture described herein are not limited in this regard.

As illustrated in FIG. 28, for example, the inner side 2790 may include a center portion 2800 having a first thickness ($T_1$), which may be generally defined as the thickness of the face portion 2775 at or near the impact area of the face portion 2775. The impact area of the face portion 2775 may be defined as a central strip down the middle of the face portion 2775 having a width of about 1.68 inches (4.27 cm). The center portion 2800 may be within the impact area of the face portion 2775. Accordingly, in one example, the center portion 2800 may have a radius of less than or equal to about 0.84 inch (2.144 cm). The radius of the center portion may refer to the largest distance from a geometric center of the center portion 2800 to the boundary of the center portion 2800 with the center portion having any symmetrical or asymmetrical shape. In another example, the center portion 2800 may have a radius of less than or equal to about 0.7 inch (1.778 cm). In yet another example, the center portion 2800 may have a radius of less than or equal to about 0.6 inch (1.524 cm). In yet another example, the center portion 2800 may have a radius of less than or equal to about 0.5 inch (1.27 cm). In yet another example, the center portion 2800 may have a radius of less than or equal to about 0.4 inch (1.27 cm). In yet another example, the center portion 2800 may have a radius that is generally similar to the radius of a golf ball (not shown). Alternatively, the center portion 2800 may be larger than the impact area. Further, portions of the center portion 2800 may extend outside the impact area while other portions of the center portion 2800 may be within the impact area. The apparatus, methods, and articles of manufacture described herein are not limited in this regard.

The first thickness may be greater than the face portion thickness ($T_1>T_{FP}$). The center portion 2800 may be located generally at the impact area of the face portion 2775 or on an area of the face portion 2775 that is used to strike a golf ball (not shown). The center portion 2800 may be offset relative to the geometric center of the face portion 2775 toward the top portion 2730, the bottom portion 2740, the toe portion 2750, or the heel portion 2760. The center portion 2800 may have any shape. For example, the center portion 2800 may be generally one or a combination of a square shape, a rectangular shape, a triangular shape, a circular shape, an elliptical shape, a pentagonal shape, a hexagonal shape, a polygonal shape, or a star shape. The apparatus, methods, and articles of manufacture described herein are not limited in this regard.

The inner side 2790 of the face portion 2775 may include a plurality of inner wall portions 2810, which are generally shown in FIG. 28 as inner wall portions 2812, 2814, 2816 and 2818. Accordingly, in the example of FIG. 28, the body portion 2710 includes four inner wall portions 2810 (i.e., first to fourth inner wall portions). A wall portion (e.g., inner wall portion or outer wall portion) as described herein may define a portion or a region of the inner side 2790 of the face portion 2775 that projects from the inner side 2790 of the face portion 2775 into the body portion 2710. In other words, a wall portion as described herein may define a portion or a region of the face portion 2775 that has a greater thickness than the face portion thickness. The inner side 2790 may include any number of inner wall portions 2810. The inner wall portions 2810 may extend from the center portion 2800 to an outer wall portion 2830 on the inner side 2790. The inner wall portions 2810 may be connected to the center portion 2800 and/or connected to the outer wall portion 2830. The inner wall portions 2810 may extend from the center portion 2800 to the outer wall portion 2830 in any configuration (i.e., in any orientation, angle, spacing between adjacent inner wall portions, etc.).

For example, the inner wall portion 2812 may extend from the center portion 2800 toward the toe portion 2750. The inner wall portion 2814 may extend from the center portion 2800 toward the bottom portion 2740. The inner wall portion 2816 may extend from the center portion 2800 toward the heel portion 2760. The inner wall portion 2818 may extend from the center portion 2800 toward the top portion 2730.

Further, the inner wall portions 2810 may vary in width. In one example shown in FIG. 29, the inner wall portions 2812 and 2816 are wider than the inner wall portions 2812 and 2816 of FIG. 28. Thus, the example of FIG. 29 is similar in many respects to the example of FIG. 29 except for the width of the inner wall portions 2812 and 2816. In another example, the width of any of the inner wall portions 2810 may be between about 0.1 inch (0.254 cm) and about 0.75 inch (1.905). In one example, the width of any or the inner wall portion 2810 may be between about 0.2 inch (0.508 cm) and about 0.5 inch (1.27 cm). The inner wall portions 2810 may also vary in cross-sectional shape. In one example, one or more of the inner wall portions may have a rectangular cross-sectional shape. In another example, one or more of the inner wall portions may have an elliptical cross-sectional shape. In yet another example, one or more of the inner wall portions may have a trapezoidal cross-sectional shape. Alternatively, the cross-sectional configuration and/or the width of each inner wall portion may vary between the center portion 2800 and the outer wall portion 2830. The apparatus, methods, and articles of manufacture described herein are not limited in this regard.

The outer wall portion 2830 may have a second thickness ($T_2$) that may be less than the first thickness ($T_2<T_1$) but greater than the face portion thickness. However, the thickness of the outer wall portion 2830 may vary. The second thickness may be generally defined as the thickness of the face portion 2775 at or near the outer wall portion 2830. The outer wall portion 2830 may at least partially surround the center portion 2800. In the example of FIG. 28, the outer wall portion 2830 resembles a loop that surrounds the center portion 2800. In one example, the first thickness may be between about 0.1 inches (0.25 cm) and about 0.2 (0.50 cm) inches, and the second thickness may be between 0.05 inches (0.13 cm) and 0.15 inches (0.38 cm). In another example, the first thickness may be between about 0.125 inches (0.32 cm) and about 0.175 inches (0.44 cm), and the second thickness may be between about 0.075 inches (0.19 cm) and about 0.125 inches (0.32 cm). The apparatus, methods, and articles of manufacture described herein are not limited in this regard.

Between the center portion 2800, the inner wall portions 2810 and the outer wall portion 2830, the inner side 2790 of the face portion 2775 may include back portion regions 2850, which are generally shown as back portion regions 2852, 2854, 2856, 2858 and 2862. Each of the back portion regions 2852, 2854, 2856 and 2858 may be bound by the center portion 2800, two adjacent inner wall portions 2810 and a corresponding portion of the outer wall portion 2830.

The back portion region 2862 may surround the outer wall portion 2830. The back portion regions 2850 may have the same thickness or have different thicknesses. The back portion regions 2850 may have a third thickness ($T_3$), which may be less than the first thickness ($T_3<T_1$) and the second thickness ($T_3<T_2$). The third thickness may be generally defined as the thickness of the face portion 2775 at or near the back portion regions 2850. In one example, the thickness of any of the back portion regions 2850 may be the same as the face portion thickness. In one example, the back portion regions 2850 may have a third thickness of between about 0.03 inches (0.762 cm) and about 0.14 inch (0.36 cm). In another example, the back portion regions 2850 may have a third thickness of between about 0.05 inch (0.127 cm) and about 0.12 inches (0.30 cm). In another example, the back portion regions 2850 may have a similar thickness as the face portion thickness. The apparatus, methods, and articles of manufacture described herein are not limited in this regard.

Each of the inner wall portions 2810 may have a constant thickness or variable thickness. In one example, the thickness of each of the inner wall portions 2810 may transition from the first thickness (T1) to the second thickness (T2) in a direction from the center portion 2800 to the outer wall portion 2830 as the inner wall portion 2810 extends from the center portion 2800 to the outer wall portion 2830. Accordingly, the thickness of each inner wall portion 2810 may be similar to the first thickness (T1) at the connection region between the inner wall portion 2810 and the center portion 2800, and the thickness of each inner wall portion 2810 may be similar to the second thickness (T2) at the connection region between the inner wall portion 2810 and the outer wall portion 2830. The apparatus, methods, and articles of manufacture described herein are not limited in this regard.

According to the examples described herein and shown in FIG. 28, the face portion 2775 may include a first region that is also referred to as the center portion 2800 at or proximate to the impact area of the face portion 2775 and has a first thickness T1 that is greater than the face portion thickness. The face portion 2775 may include a second region that is also referred to herein as the outer wall portion 2830, which at least partially surrounds the first region and has a second thickness T2 that is less than the first thickness T1. The face portion 2775 may include a plurality of third regions that are also referred to as the inner wall portions 2810 and have a constant or variable thickness of less than or equal to the first thickness T1 and greater than or equal to the second thickness T2. The face portion 2775 may include a plurality of fourth regions that are also referred to herein as the back portion regions 2850 and have a third thickness T3 of less than the first thickness T1 and the second thickness T2, or alternatively, have the third thickness T3 that is similar to the face portion thickness. The back portion region 2862 may be referred to herein as a fifth region that has the third thickness T3 and surrounds the second region or the outer wall portion 2830. Thus, the face portion 2775 includes a plurality of regions having different thicknesses configured as described herein. The apparatus, methods, and articles of manufacture described herein are not limited in this regard.

The terms "and" and "or" may have both conjunctive and disjunctive meanings. The terms "a" and "an" are defined as one or more unless this disclosure indicates otherwise. The term "coupled" and any variation thereof refer to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby", "neighboring", etc., and such terms may be used interchangeably as appearing in this disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the USGA, the R&A, etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Further, while the above examples may be described with respect to golf clubs, the apparatus, methods and articles of manufacture described herein may be applicable to other suitable types of sports equipment such as a fishing pole, a hockey stick, a ski pole, a tennis racket, etc.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf club head comprising:

a hollow body portion having a rear portion, a toe portion, a heel portion, a top portion, a bottom portion, and a front portion including a face portion, the face portion comprising:

a center portion projecting into the hollow body portion from an inner side of the face portion, the center portion having a first thickness;

an outer wall portion projecting into the hollow body portion from the inner side of the face portion, the outer wall portion at least partially surrounding the center portion, the outer wall portion having a second thickness less than the first thickness;

a plurality of inner wall portions projecting into the hollow body portion from the inner side of the face portion, the plurality of inner wall portions connecting the center portion to the outer wall portion; and a plurality of back portion regions, each back portion region being surrounded by a portion of the outer wall portion, the center portion and adjacent inner wall portions, each back portion region of the plurality of back portion regions having a third thickness less than the first thickness and the second thickness, wherein a thickness of each inner wall portion of the plurality of inner wall portions decreases from the first thickness to the second thickness in a direction from the center portion to the outer wall portion.

2. A golf club head as defined in claim 1, wherein the center portion has a substantially constant thickness defined by the first thickness.

3. A golf club head as defined in claim 1, wherein the outer wall portion is a loop that surrounds the center portion.

4. A golf club head as defined in claim 1, wherein the plurality of inner wall portions comprise a first inner wall portion extending horizontally from the center portion toward the toe portion, a second inner wall portion extending vertically from the center portion toward the bottom portion, a third inner wall portion extending horizontally from the center portion toward the heel portion, and a fourth inner wall portion extending vertically from the center portion toward the top portion.

5. A golf club head as defined in claim 1, wherein the plurality of inner wall portions comprise a first inner wall portion extending from the center portion toward the toe portion, a second inner wall portion extending from the center portion toward the bottom portion, a third inner wall portion extending from the center portion toward the heel portion, and a fourth inner wall portion extending from the center portion toward the top portion.

6. A golf club head as defined in claim 1, wherein the first thickness is between 0.1 inch and 0.2 inch, and the second thickness is between 0.05 inch and 0.15 inch.

7. A golf club head comprising:

a hollow body portion having a rear portion, a toe portion, a heel portion, a top portion, a bottom portion, and a front portion including a face portion, the face portion comprising:

a center portion projecting into the hollow body portion from an inner side of the face portion, the center portion having a first thickness;

an outer wall portion projecting into the hollow body portion from the inner side of the face portion, the outer wall portion at least partially surrounding the center portion, the outer wall portion having a second thickness;

a plurality of inner wall portions projecting into the hollow body portion from the inner side of the face portion, the plurality of inner wall portions connecting the center portion to the outer wall portion; and a plurality of back portion regions, each back portion region being surrounded by a portion of the outer wall portion, the center portion and adjacent inner wall portions, each back portion region of the plurality of back portion regions having a third thickness less than the first thickness and the second thickness, wherein a thickness of an inner wall portion of the plurality of inner wall portions decreases in thickness from a first thickness at a first connection region between the inner wall portion and the center portion to a second thickness at a second connection region between the inner wall portion and the outer wall portion.

8. A golf club head as defined in claim 7, wherein the center portion has a substantially constant thickness.

9. A golf club head as defined in claim 7, wherein the first thickness is between 0.1 inch and 0.2 inch, and the second thickness is between 0.05 inch and 0.15 inch.

10. A golf club head as defined in claim 7, wherein the center portion has a radius of less than 0.84 inch.

11. A golf club head as defined in claim 7, wherein a thickness of each inner wall portion of the plurality of inner wall portions decreases from the first thickness to the second thickness in a direction from the center portion to the outer wall portion.

12. A golf club head as defined in claim 7, wherein the plurality of inner wall portions comprise a first inner wall portion extending from the center portion toward the toe portion, a second inner wall portion extending from the center portion toward the bottom portion, a third inner wall portion extending from the center portion toward the heel portion, and a fourth inner wall portion extending from the center portion toward the top portion.

13. A driver-type golf club head comprising:

a hollow body portion having a rear portion, a toe portion, a heel portion, a top portion, a bottom portion, and a front portion including a face portion, the face portion comprising:

a strike face;

an inner side opposite the strike face;

a center portion projecting into the hollow body portion from the inner side of the face portion, the center portion having a first thickness;

an outer wall portion projecting into the hollow body portion from the inner side of the face portion, the outer wall portion at least partially surrounding the center portion, the outer wall portion having a second thickness less than the first thickness;

a plurality of inner wall portions projecting into the hollow body portion from the inner side of the face portion, the plurality of inner wall portions connecting the center portion to the outer wall portion; and a plurality of back portion regions, each back portion region being surrounded by a portion of the outer wall portion, a portion of the center portion, and adjacent inner wall portions, the plurality of back portion regions comprising a first back portion region being closer to the toe portion than the heel portion and closer to the bottom portion than the top portion, a second back portion region being closer to the heel portion than the toe portion and closer to the bottom portion than the top portion, a third back portion region being closer to the heel portion than the toe portion and closer to the top portion than the bottom portion, and a fourth back portion region being closer to the toe portion than the heel portion and closer to the top portion than the bottom portion, wherein a thickness of each inner wall portion of the plurality of inner wall portions decreases from the first thickness to the second thickness in a direction from the center portion to the outer wall portion, and wherein the golf club head has a volume greater than or equal to 300 cubic centimeters.

14. A golf club head as defined in claim 13, wherein the plurality of inner wall portions comprise a first inner wall portion extending from the center portion toward the toe portion, a second inner wall portion extending from the center portion toward the bottom portion, a third inner wall portion extending from the center portion toward the heel portion, and a fourth inner wall portion extending from the center portion toward the top portion.

15. A golf club head as defined in claim 13 further comprising a plurality of back portion regions, each back portion region being surrounded by a portion of the outer wall portion, a portion of the center portion, and adjacent inner wall portions.

16. A golf club head as defined in claim 13, wherein at least one of the plurality of inner wall portions has a trapezoidal cross-section shape.

17. A golf club head as defined in claim 13, wherein at least one of the plurality of inner wall portions has a rectangular cross-section shape.

18. A golf club head as defined in claim 13, wherein the plurality of inner wall portions comprise a first inner wall portion extending horizontally from the center portion toward the toe portion, a second inner wall portion extending vertically from the center portion toward the bottom portion, a third inner wall portion extending horizontally from the center portion toward the heel portion, and a fourth inner wall portion extending vertically from the center portion toward the top portion.

* * * * *